US008540545B2

(12) United States Patent
Leicht

(10) Patent No.: US 8,540,545 B2
(45) Date of Patent: Sep. 24, 2013

(54) INTERCONNECTIBLE BUILDING ELEMENTS FOR INTELLECTUAL CHALLENGE GAMES

(76) Inventor: Boaz Leicht, Longmont, CO (US)

( * ) Notice: Subject to any disclaimer, the term of this patent is extended or adjusted under 35 U.S.C. 154(b) by 291 days.

(21) Appl. No.: 13/021,923

(22) Filed: Feb. 7, 2011

(65) Prior Publication Data

US 2012/0032393 A1 Feb. 9, 2012

Related U.S. Application Data

(60) Provisional application No. 61/302,108, filed on Feb. 6, 2010.

(51) Int. Cl.
*A63H 33/06* (2006.01)
*A63H 33/08* (2006.01)

(52) U.S. Cl.
USPC ..... 446/118; 446/124

(58) Field of Classification Search
CPC ..... A63H 33/00; A63H 33/04; A63H 33/08; A63H 33/10; A63H 33/12
USPC ..... 446/85, 86, 104–108, 111, 118, 446/120–124; 273/153 R, 156, 157 R
See application file for complete search history.

(56) References Cited

U.S. PATENT DOCUMENTS

| | | | |
|---|---|---|---|
| 1,400,066 | A | 12/1921 | Huck |
| 1,446,868 | A | 2/1923 | Baker |
| 1,472,536 | A | 10/1923 | Thomson |
| 2,100,658 | A | 11/1937 | Finch |
| 2,451,747 | A | 10/1948 | Kindt |
| 2,609,638 | A | 9/1952 | Lindenmeyer |
| 2,803,088 | A | 8/1957 | Swann |
| 2,910,737 | A | 11/1959 | MacMillan |
| 3,659,376 | A | 5/1972 | Fischer |
| 3,681,870 | A | 8/1972 | Alpert |
| 3,689,075 | A | 9/1972 | Adelsohn |
| 3,864,051 | A | 2/1975 | Reid |
| 3,895,456 | A | 7/1975 | Fabre |

(Continued)

FOREIGN PATENT DOCUMENTS

| | | |
|---|---|---|
| DE | 4418003 A1 | 11/1995 |
| FR | 2574876 | 6/1986 |

(Continued)

OTHER PUBLICATIONS

International Search Report and Written Opinion of PCT/US2011/023901 mailed on Mar. 31, 2011, 9 pages.

(Continued)

*Primary Examiner* — Kien Nguyen
(74) *Attorney, Agent, or Firm* — Holland & Hart LLP

(57) ABSTRACT

Embodiments may including multiple building elements that may include connector building elements and basic building elements for the construction of three-dimensional puzzles. Connector building elements may include a connector portion that may insert into a receiving portion of a basic building element. Connector building elements and basic building elements may rotate with respect to each other to a fixed point where respective faces of the connector building element and the basic building element are aligned; the alignment may be to pre-determined angles. Connector building elements and/or basic building elements may include blocking and/or locking structures that may resist and/or arrest the rotation of the elements with respect to each other and to aid in maintaining the alignment of the elements.

24 Claims, 33 Drawing Sheets

(56) References Cited

U.S. PATENT DOCUMENTS

| | | | | |
|---|---|---|---|---|
| 4,003,144 | A | 1/1977 | Maddestra et al. | |
| 4,551,110 | A | 11/1985 | Selvage et al. | |
| 4,637,805 | A | 1/1987 | Sweetin | |
| 4,758,195 | A | 7/1988 | Walsh | |
| 4,903,451 | A | 2/1990 | Gresswell | |
| 4,932,916 | A | 6/1990 | Blickle | |
| 5,137,452 | A | 8/1992 | Pollock | |
| 5,238,231 | A | 8/1993 | Huang | |
| 5,239,803 | A * | 8/1993 | Shannon | 52/653.1 |
| 5,306,198 | A | 4/1994 | Forman | |
| 5,368,427 | A | 11/1994 | Pfaffinger | |
| 2,703,724 | A | 3/1995 | Der Yuen et al. | |
| 5,645,464 | A | 7/1997 | Chen | |
| 5,771,650 | A | 6/1998 | Williams et al. | |
| 5,921,781 | A | 7/1999 | Shaw | |
| 5,938,498 | A | 8/1999 | Glynn | |
| 6,241,248 | B1 | 6/2001 | Winter | |
| 6,332,281 | B1 | 12/2001 | Savoie | |
| 6,644,665 | B1 | 11/2003 | Brooks | |
| 6,679,646 | B2 | 1/2004 | Quardt et al. | |
| 6,711,865 | B2 * | 3/2004 | Chaudoreille | 52/603 |
| 7,481,692 | B2 | 1/2009 | Bruder | |
| 2008/0160875 | A1 | 7/2008 | Leicht | |

FOREIGN PATENT DOCUMENTS

| | | | |
|---|---|---|---|
| FR | 2813805 | A1 | 3/2002 |
| GB | 190904605 | | 0/1910 |
| GB | 214821 | | 5/1924 |
| GB | 1112694 | | 5/1968 |
| GB | 2108857 | A | 5/1983 |
| GB | 2384721 | A | 8/2003 |
| GB | 2393134 | A | 3/2004 |
| JP | 4161186 | A | 6/1992 |
| JP | 2001170369 | A | 6/2001 |

OTHER PUBLICATIONS

International Search Report for PCT/IL05/00879 mailed Apr. 21, 2006.

U.S. Appl. No. 12/063,982, filed Feb. 15, 2008, Office Action mailed Sep. 3, 2009, 10 pages.

U.S. Appl. No. 12/063,982, filed Feb. 15, 2008, Final Office Action mailed Apr. 27, 2010, 13 pages.

U.S. Appl. No. 12/063,982, filed Feb. 15, 2008, Office Action mailed Dec. 22, 2010, 12 pages.

* cited by examiner

INTERCONNECTIBLE BUILDING ELEMENTS FOR INTELLECTUAL CHALLENGE GAMES

CROSS-REFERENCES TO RELATED APPLICATIONS

This application is related to and claims the benefit of U.S. Provisional Patent Appl. No. 61/302,108, filed on Feb. 6, 2010, titled "Interconnectible Building Elements For Intellectual Challenge Games," and this application is related to the following, commonly assigned applications: U.S. patent application Ser. No. 12/063,982, filed on Feb. 15, 2008, titled "Interconnectible Building Elements For Intellectual Challenge Games," and PCT Pat. Appl. No. PCT/IL05/000879, filed on Aug. 15, 2005, titled "Interconnectible Building Elements For Intellectual Challenge Games," each of which is incorporated herein by reference in its entirety for all purposes.

BACKGROUND

Many constructional toys enable creative assembly into diverse forms. Thus for example GB 2384721 teaches a construction toy comprised of brick like elements which have receiving means extending through and mats with receiving means representing mortar, to be joined together by plastic dowels for constructing buildings of different designs.

Similarly, GB 2108857 comprises a building toy system with a basic element of two components secured together into which orthogonally arranged securing means such as rods, dowels or pegs may be introduced, thus enabling free building of different shapes, while GB 214821 teaches a toy building element having right angled corners and equispaced grooves that may be connected by using hinges, clips, bolts etc.

Finally, JP 4161186 proposes a kit with hollow elements that may be interconnected using separate connecting members that fit into receiving means in the elements.

All of these toys may be directed at the creative power of the child and propose an amusing, variable pastime as well as the development of mechanical skills.

Different kinds of constructional games pose technical and logical problems due to certain predefined limitations of structure that make the task of creating a construction of preset shape an intellectual challenge. It is characteristic of these games that the main configuration remains unchanged.

A well known example is Rubik's cube. Another example is UK 4605 (of 1909) consisting of a box to be moved around inside a cube made of an inner part and an outer part until it is released. Yet another example is a special logical toy, described in U.S. Pat. No. 6,644,665 that has a total of 26 elements mounted on a spherical internal connecting element. The toy elements, marked by colors, numbers etc., are mixed by rotation and the objective is to return them to the original arrangement.

There is a need for a game that combines creative freedom and intellectual challenge by providing separate building elements with connecting pieces that may be freely assembled into a large variety of different composite building elements and wherein the said different composite building elements have different configurations and connecting pieces may be attached on the faces of the said composite building elements in various positions such that a nearly infinite number of final structures may be created by assembling the said composite building elements, but only a limited number of modes of assembly for a predefined final structure exist when using the same composite building elements.

There is a need for a game in which a large variety of different puzzles may be created by a first player using the same kit of building elements and connecting pieces by assembling different composite building elements with different arrays of connecting pieces on their faces, and creating a final structure by assembling the said composite elements, which final structure may then be presented as a puzzle to a second player to disassemble and reconstruct the said final structure using the same composite building elements.

There is a need for a puzzle game in which the level of intellectual challenge may be controlled according to the players' wish or to their abilities while using the same basic building elements and connecting pieces.

BRIEF SUMMARY

Embodiments may include a puzzle construction system. The system may include multiple basic building elements. Basic building elements may include multiple external faces. One or more of the external faces may include a receiving or receptor portion. Basic building elements may include multiple blocking structures, where each blocking structure is configured to block a respective lateral structure of a connecting portion of a connector building element in a position such that an external face of a respective connecting building element may align with an respective external face of a respective basic building element. The alignment may be involve a symmetrical align of the faces; in some cases, this may include align the edges of respective building elements so that they are parallel to each other.

Basic building elements may include multiple locking structures, each locking structure configured to maintain a respective lateral structure of a respecting connecting portion of a respective connector building element in the position such that a respective external face of a connector building element aligns with a respective external face of a respective basic building element. The system may also include multiple connector building elements. Connector building elements may include multiple external faces. Some of the external faces may include receiving portions. Some of the external faces may couple with a connecting or connector portion, the connecting portion may include one or more longitudinal structures and one or more lateral structures coupled with an end portion of one of the respective longitudinal structures.

In some embodiments, the puzzle construction system may include basic building elements and/or connector building elements that also include multiple internal ramp structures, each internal ramp structured configured to provide compressive force to a respective lateral structure of a respective connecting portion of a respective connector building element. In some cases, the one ore more of the respective internal ramp structures may be coupled with at least a respecting locking structure or a respective blocking structure. Some embodiments may include at least one of the respective internal ramping structures that includes a portion with a first width and a second width such that a respective lateral structure receives the compressive force when the lateral structure is rotated past the first width and the lateral structure is held in place against a respective blocking structure when the lateral structure aligns with the portion of the internal ramping structures with the second width In some embodiments, at least one of the respective locking structures includes a first portion with a first length and at least one of the respective block structures includes a second portion with a second length, the first length being less than the second length and the first portion and the second portion parallel to each other.

In some embodiments, at least one of the receiving portions includes an elongated opening. In some embodiments, the respective receiving portion further includes a circular depression that includes the elongated opening.

In some embodiments, the connecting portion includes one or more longitudinal structures and one or more lateral structures coupled with an end portion of the longitudinal structure is configured as T-shaped structure. In some embodiments, the connecting portion includes one or more longitudinal structures and one or more lateral structures coupled with an end portion of the longitudinal structure is configured as first L-shaped structure separated by a gap from a second L-shaped structure. In some embodiments, the one or more lateral structures may be coupled with one or more protrusions configured to act as a screw driver structure.

Some embodiments of the puzzle construction system may include one or more blocking or protrusion elements. A blocking element may include a body portion, where the body element includes one or more slots in a first face of the body portion. The blocking element may include one or more longitudinal structures extending from a second face of the body portion. The blocking element may include one or more lateral structures coupled with the one or more longitudinal structures. The blocking elements may add to the possible puzzle configurations that may be made with the building elements.

Some embodiments of the puzzle construction system may include one or more connector or connecting elements. A connector element may include a body portion. The connector element may include one or more longitudinal structures extending from a first side of the body portion one or more longitudinal structures extending from a second side of the body portion. The connector element may include one or more lateral structures coupled with the one or more longitudinal structures extending from the first side of the body portion and the second side of the body portion.

Some embodiments may include a method of constructing an intellectual challenge puzzle game. The method may include selecting one or more basic building elements, where each basic building element includes: multiple external faces, where one or more of the external faces includes a receiving portion; multiple blocking structures, each blocking structure configured to block a respective lateral structure of a connecting portion of a connector building element in a position such that an external face of a respective connecting building element aligns with an respective external face of a respective basic building element; and multiple locking structures, each locking structure configured to maintain a respective lateral structure of a respecting connecting portion of a respective connector building element in the position such that a respective external face of a connector building element aligns with a respective external face of a respective basic building element. The method may include selecting one or more connector building elements, where each connector building element includes multiple external faces, with at least a subset of the external faces include a receiving portion and at least a subset of the external faces couple with a connecting portion, the connecting portion including one or more longitudinal structures and one or more lateral structures coupled with an end portion of one of the respective longitudinal structures. The method may include constructing multiple puzzle segments, wherein each respective puzzle segment includes one or more of the selected basic building elements and one or more the selected connector building elements that are combined by inserted the connecting portion of a respective connector building element into a respective receiving portion of at least one of the selected basic building elements or the selected connector building elements and rotated until a respective lateral structure meets a respective blocking structure to form a puzzle including the plurality of puzzle segments.

In some embodiments, the puzzle segments may be configured such that every connecting portion of the one or more respective connector building elements is inserted into a respective receiving portion of at least one of the selected basic building elements or the selected connector building elements.

Some embodiments of the method of constructing an intellectual challenge puzzle game may further include connecting a blocking element into at least receiving portion of a respective external face of at least one of the basic building elements or connector building elements. Some embodiments of the method of constructing an intellectually challenge puzzle game may further include assembling the multiple puzzle segments into a puzzle configuration. Some embodiments of the method of constructing an intellectually challenge puzzle game may further include disassembling the puzzle configuration into the multiple puzzle segments and providing the disassembled puzzle segments for reassembly by another. In some embodiments, the puzzle configuration defines a three dimensional cube.

Some embodiments may include a puzzle device for constructing intellectual challenging puzzle games. The puzzle device may include multiple external faces, where one or more of the external faces includes a receiving portion. The puzzle device may include multiple blocking structures, each blocking structure configured to block a respective lateral structure of a connecting portion of a connector building element in a position such that an external face of a respective connecting building element symmetrically aligns with an respective external face of a respective basic building element. The puzzle device may include multiple locking structures, each locking structure configured to maintain a respective lateral structure of a respecting connecting portion of a respective connector building element in the position such that a respective external face of a connector building element aligns with a respective external face of a respective basic building element.

In some embodiments, at least a subset of the external faces couple with a connecting portion, the connecting portion including one or more longitudinal structures and one or more lateral structures coupled with an end portion of one of the respective longitudinal structures.

Some embodiments of the puzzle device may further include multiple internal ramp structures, each internal ramp structured configured to provide compressive force to a respective lateral structure of a respective connecting portion of a respective connector building element. In some cases, one or more of the respective internal ramp structures is a coupled with at least a respecting locking structure or a respective blocking structure. In some embodiments, at least one of the respective internal ramping structures includes a portion with a first width and a second width such that a respective lateral structure receives the compressive force when the lateral structure is rotated past the first width and the lateral structure is held in place against a respective blocking structure when the lateral structure aligns with the portion of the internal ramping structures with the second width.

In some embodiments, at least one of the respective locking structures may include a first portion with a first length and at least one of the respective block structures includes a second portion with a second length, the first length being less than the second length and the first portion and the second portion parallel to each other. In some embodiments, at least one of the receiving portions may include an elongated opening. In some embodiments, the respective receiving portion may further include a circular depression that includes the elongated opening. In some embodiments, the connecting portion may include one or more longitudinal structures and one or more lateral structures coupled with an end portion of the longitudinal structure is configured as T-shaped structure. In some embodiments, the connecting portion may include one or more longitudinal structures and one or more lateral structures coupled with an end portion of the longitudinal structure is configured as first L-shaped structure separated by a gap from a second L-shaped structure.

BRIEF DESCRIPTION OF THE DRAWINGS

A further understanding of the nature and advantages of embodiments may be realized by reference to the following drawings. In the appended figures, similar components or features may have the same reference label. Further, various components of the same type may be distinguished by following the reference label by a hyphen and a second label or third label that distinguishes among the similar components. The second or third label may also be used merely to distinguish components that are part of different figures. If the first reference label is used in the specification, the description is applicable to any one of the similar components having the same first reference label irrespective of the second reference or third labels.

DETAILED DESCRIPTION

Figure 1B:
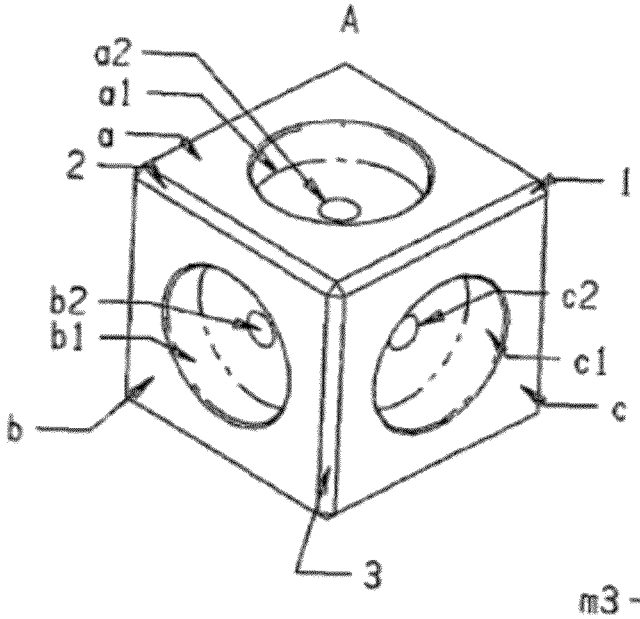
FIG. 1 shows a basic building element and a connecting piece, in accordance with various embodiments.

This description provides example embodiments only, and is not intended to limit the scope, applicability, or configuration of the invention. Rather, the ensuing description of the embodiments will provide those skilled in the art with an enabling description for implementing embodiments of the invention. Various changes may be made in the function and arrangement of elements without departing from the spirit and scope of the invention.

Thus, various embodiments may omit, substitute, or add various procedures or components as appropriate. For instance, it should be appreciated that in alternative embodiments, the methods may be performed in an order different from that described, and that various steps may be added, omitted, or combined. Also, features described with respect to certain embodiments may be combined in various other embodiments. Different aspects and elements of the embodiments may be combined in a similar manner.

It should also be appreciated that the following systems, methods, and software may individually or collectively be components of a larger system, wherein other procedures may take precedence over or otherwise modify their application. Also, a number of steps may be required before, after, or concurrently with the following embodiments.

Embodiments may include an intellectual challenge construction kit to be applied in a game for one or more players. Embodiments may comprise a plurality of basic building elements and a plurality off connecting means adapted to be received in receiving means provided on the said basic building elements that enable the assembly of a huge variety of composite building blocks of different shapes and with different patterns of connecting means on their outer faces. Thus an almost infinite number of different construction kits with different composite building elements may be created using the same basic building elements and connecting pieces. Such a construction kit may be prepared by a first player to be used by the said first player for assembling a pre defined structure, while overcoming hindrances created by connecting pieces at some positions and using to advantage the connecting pieces that facilitate attachment of two adjacent composite building elements at other positions. The first player may then present, in some embodiments, the pre defined structure to a second player and challenge him to take apart the said pre defined pre defined structure and reassemble it using the same composite building elements with the same attachment means at the same positions that were used by the first player. In some embodiments, a first player may not necessarily have to present the pre defined structure to a second player. In some embodiments, a first player may present a pre defined structure to multiple other players.

In accordance with embodiments, the basic building elements may be made in many different shapes including, but not limited to, a cube, a tetrahedron or any other polyhedron, a prism, a trapezoid, a cylinder, a cone, etc.

The connecting pieces may also be made in different designs such as pegs with conical heads, pointed heads of any structural design, flat heads that may be cylindrical or prismoidal, flower shaped heads, animal shaped heads, etc. Other embodiment of connecting pieces may have other configurations as will be discussed below. It will be understood that at least some of the receiving means must have a shape that enables the said receiving means to receive the said heads if the said connecting pieces. The connecting pieces may also have attachment means such as stems with bayonet pin and socket attachment means, threaded stems etc. that enable fast attachment of the connecting pieces within receiving means having a shape that enables the said attachment means to be received and attached in the said receiving means. In some embodiments, a connecting piece may be integrated with a basic building block to creating a connector unit, as will be discussed.

In accordance with various embodiments, the said basic building elements may be cubes with six equivalent faces, on each of the faces of the said basic building elements a cylindrical depression is disposed and at the center of the said cylindrical depression a bored hole is provided. In some embodiment, the connecting pieces may have threaded stems and flat cylindrical heads such that the cylindrical heads are adapted to be tightly received in the said cylindrical depressions and the said threaded stems are adapted to be threaded into the said bored holes. In some embodiments, connecting pieces may be used to assemble a selected number of basic building elements into a composite building element wherein the composite building element may be a straight row of basic building elements in the shape of a prism, or it may be assembled of five building elements to form a branched T design, assembled of three basic building elements creating an L shape, or it may be assembled according to any other design including designs branched in three dimensions, selected at will by a player.

In accordance with various embodiments, a construction kit may comprise integral building elements designed to simulate the above described composite building elements. The integral building elements may have generally the same shapes and proportions as if they were composite building elements assembled from basic building elements and their outer surfaces are marked by transversely disposed grooves appropriately positioned to simulate grooves separating adjacent basic building elements.

In one embodiment, the construction kit comprises 27 basic building elements having the shape of a cube with six faces and bevel edges, each of the basic building elements having a centrally located cylindrical depression with a bored hole at the center of the said cylindrical depression on each of its six faces. The construction kit may further comprise a plurality of connecting pieces shaped as screws with a head having a cylindrical shape and a diameter that enables it to be tightly received in the said depressions and a threaded stem that can be screwed into the said bored holes. Some embodiments may include connecting pieces or connector units that may have other shapes as discussed below.

In some embodiments, basic building elements may be assembled into 9 composite building elements each consisting of three basic building elements. Each of the composite building elements may be assembled by screwing the threaded stem of a first connecting piece into a bored hole in a first basic building element and introducing the head of the said first connecting piece into a cylindrical depression in a first face of a second building element such that the said head is tightly received in the said cylindrical depression, then screwing the threaded stem of a second connecting piece into a bored hole in a second face of the second building element that is opposite and parallel to the said first face of the second building element, and finally introducing the head of the said first connecting piece into a cylindrical depression in a first face of a third building element such that the said head is tightly received in the said cylindrical depression. Other embodiments may utilize other connecting pieces and/or connector unit configurations, some of which are discussed below and shown in the figures.

In accordance with some embodiments, an intelligence game may be played using the said composite elements wherein a first player may introduce further connecting pieces into bored holes at pre defined positions on the outer faces of the said composite building elements by screwing the stems of the said connecting pieces into the said bored holes in the center of the said cylindrical depressions. It will be understood that a connecting piece may be driven into a bored hole until the cylindrical head of the said connecting piece is wholly received in the said cylindrical depression and the said cylindrical head comes to lie generally level with the surface of the said composite element or the said cylindrical head may be only partly received in the said cylindrical depression such that the said cylindrical head is protruding from the surface of the said composite element. Other embodiments may include basic building elements and connecting pieces or connecting means with different connecting configurations, some of which are discussed below and shown in the figures that may be used to create composite elements.

In accordance with another embodiment, a computerized spatial game may be provided, comprising inter alia the following steps, merely by way of example: (a) selecting a plurality of basic building elements being displayed as a cube or any other object having a plurality of outer faces, with a depression disposed on at least a portion (e.g., one or more faces, every face etc) of the said faces and with a hole centrally disposed within at least a portion of the said depressions respectively; (b) selecting a plurality of connecting pieces, each of the said connecting pieces having a stem adapted to be tightly received in one of the said receiving means in a first basic building element and each of the said connecting pieces further having a head adapted to be tightly received in one of the said depressions on a face of a second basic building element such that the said basic building elements may be interconnected by the said connecting pieces to create a composite building element; (c) selecting a number of connecting pieces adapted to be attached at selected positions on the outer faces of the said composite building elements; and (d), constructing at least one predefined structure in the manner that the said stems are tightly received in the said receiving means on the faces of the said composite building elements and the said heads are abutting from the said outer faces of the said composite building elements in a manner that may hinder or facilitate the assembly of the said composite building elements into a predefined structure whereby the said composite building elements must be arranged in a specific manner so as to enable the computerized assembly of the said predefined structure. Other embodiments may include basic building elements and connecting pieces or connecting means with different connecting configurations, some of which are discussed below and shown in the figures that may be used to create composite elements.

In accordance with yet another embodiment, a method of playing an intellectual challenge game may be provided, this method comprising inter alia (a) assembling a plurality of basic building elements into a plurality of composite building elements by using a plurality of connecting pieces each of said pieces being adapted to interconnect two or more basic building elements; (b) introducing a plurality of connecting pieces into a plurality of receiving means on one or more of the outer faces of the composite building elements, thereby enabling a variety of different composite building elements; wherein the shapes of said composite building elements and the positions of said connecting pieces on the outer faces of said composite building elements are designed by a first player such that they are mutually compatible III a manner that enables the player to assemble a pre-defined structure using the said composite building elements; (c) assembling said pre-defined structure from said composite building elements; (d) optionally creating a pattern on the outer surface of the said pre-defined structure by introducing a plurality of connecting pieces into the receiving means on the outer surface of said pre-defined structure; and (e), presenting at least a second player with the challenge of disassembling said pre-defined structure into its separate composite building elements and, without changing the positions of the connecting pieces on the said composite building elements, to reassemble the same structure with the same pattern on its outer surface from the same composite building elements that were used by the first player. Other embodiments may include basic building elements and connecting pieces or connecting means with different connecting configurations, some of which are discussed below and shown in the figures that may be used to create composite elements. Some embodiments may allow for more or less or players to participate.

It will be understood that as a result of introducing the connecting means in the bored holes or other receiving means on the outer faces of the said composite building blocks in the above described manner various fits and misfits between the different composite building element may be created such that where a first connecting piece protruding from a first composite building element is juxtaposed to a second connecting piece protruding from a second composite building element, this configuration is a misfit that hinders the coupling of the said first and second composite building elements whereas where a connecting piece protruding from a first composite building element is juxtaposed to a cylindrical depression in a second composite building element, this configuration is a fit that facilitates the coupling of the said first and second composite building elements.

It will be further understood that where the threaded stem of a connecting piece is screwed into the said bored hole until its cylindrical head is received in the said cylindrical depression whereby it comes to lie level with the face of a composite building element, such connecting piece will neither facilitate nor hinder the coupling of the said first and second composite building elements. Other embodiments may include basic building elements and connecting pieces or connecting means with different connecting configurations that may result in connecting pieces that neither facilitate nor hinder the coupling of building elements, some of which are discussed below and shown in the figures that may be used to create composite elements.

These composite building elements may now be used by a player to assemble different kinds of structures such as a cube in which the size of each of the three dimensions length, width and depth is equal to the length of three basic building elements assembled in a row.

Using the basic building elements and connecting pieces may allow for an almost unlimited number of different composite building elements and structures may be created in accordance with the desired level of difficulty which in turn may be suited to the abilities of the players.

It will be further understood that the variability of the inventive construction kit may be further increased due to the fact that many different kinds of composite building elements with differently positioned connecting pieces may be used to assemble the same structure.

Thus even in a simple embodiment of 9 composite building elements of equal size and shape that are assembled into a cube structure, the said cube structure may be assembled in accordance with any of a large number of variations by altering the distribution of the connecting pieces on the different faces of the composite building elements.

Embodiments with a construction kit and intellectual construction game may include a large number of variations that is made possible by the variability of the distribution of the connecting pieces on the faces of the composite building elements. It will be understood that in some embodiments the total number of receiving means in a composite building element that is made of three basic building elements, each basic building element having a receiving means on each of its faces, may be 14. As a result, to each of the composite building elements any number of connecting pieces may be added by the first player in a range of 1-14 and a considerable number of different modes of distributing the said connecting pieces by introducing the said connecting pieces into receiving means at different locations on the faces of the said composite building element may be available.

It will be further understood that more than one receiving means for more than one type of connecting piece may be provided on a face of a basic building element once more increasing the variability of the game that may be played using the same basic construction set.

In accordance with embodiments of the intellectual challenge game, the number of limitations imposed by a player may be increased and the level of difficulty elevated such as by defining a pattern of connecting pieces on the outer surface of the cubic structure and challenging the second player to reconstruct the said pattern while reassembling the said cubic structure.

In accordance with other embodiments of a construction kit, the connecting pieces may be disposed such that they are protruding from a composite building element at different orientations, with direct angles between the said orientations of the said connecting pieces. In this case a further obstacle is created that raises the level of difficulty due to the fact that it becomes compulsory to connect the said composite building element in its predestined position prior to connecting any adjacent composite building elements that may obstruct the placing of the said composite building element in the said predestined position due to the said protrusion of the said connecting pieces.

Additional ways of increasing the level of difficulty are made possible by adding further variations in the basic elements such as differently colored basic building elements or differently colored connecting pieces, using connecting pieces that are designed to fit into differently designed depressions, using connecting pieces of varied heights, etc. IN some embodiments, the level of difficulty may depend on several variable elements of the novel construction game such as, but not limited, to the following:

1. The design of the basic building elements
2. The configuration of the composite building elements, whether cuboid or polygonal objects, T shaped, L shaped or curved shaped etc.
3. The structure to be assembled.
4. The design of the connecting pieces.
5. Any configurations imposing a predefined order of assembly wherein a second composite building element must be attached to a first composite building element prior to a third composite building element and the final construction cannot be achieved in any other manner.
6. Patterns on the outer surface of the final construction.
7. Patterns of different colors and/or designs of the basic building elements and/or the connecting pieces.
8. The number of receiving means on a face of a basic building element.

Embodiments may enable the creation of simple planar puzzles suitable for children of different ages as well as complex puzzles on different levels for adults of varied capabilities. Embodiments may be applied as clinical or educational a tool for testing the players' intelligence or developmental stage.

It will be understood that embodiments may involve many other variations and modifications of the inventive construction kit may be made that still remain within the scope of the invention. In some embodiments, the construction kit comprises a limited number of basic building elements.

Figure 1A:
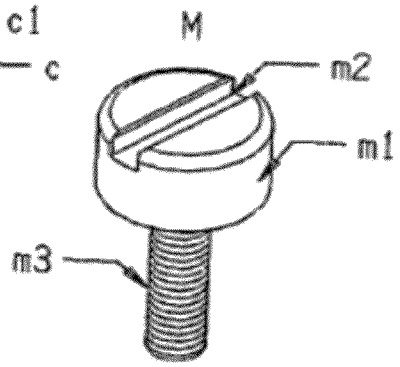

FIG. 1 shows a basic building element A having the general form of a cube with six faces. It will be understood that FIG. 1 being a perspective view of the basic building element, only three faces a, band c of the basic building element are visible. The basic building element has six bevel edges. In FIG. 1 bevel edges 1,2 and 3 are shown. Each of the faces of the basic building element A is made with a centrally positioned cylindrical depression. In FIG. 1 cylindrical depressions a1, b1 and c1 in faces a, band c respectively of the basic building element A are shown. At the center of each of the cylindrical depressions a bored hole may be provided. In FIG. 1, bored holes a2, b2 and c2 at the centers of cylindrical depressions a1, b1 and c1 respectively are shown.

In accordance with some embodiments, a construction kit may further comprise connecting pieces for connecting the basic building elements. A connecting piece M is shown in FIG. 1. As seen in FIG. 1, the connecting piece M has a flat head m1 with a cylindrical shape and a groove m2 extending across the upper surface of the flat head m1. A threaded stem m3 is downwardly extending from the flat head m1 at a straight angle to the flat head m1. In accordance with some embodiments, the threaded stem m3 is adapted for screwing into a bored hole such as a2 or b2 or c2 on the face of a basic building element and the flat head m1 is adapted to be tightly received in a cylindrical depression such as a1 or b1 or c1. Other embodiments may utilize connecting pieces with different designs and configurations as discussed, for example, below and shown in some figures.

Figure 2:
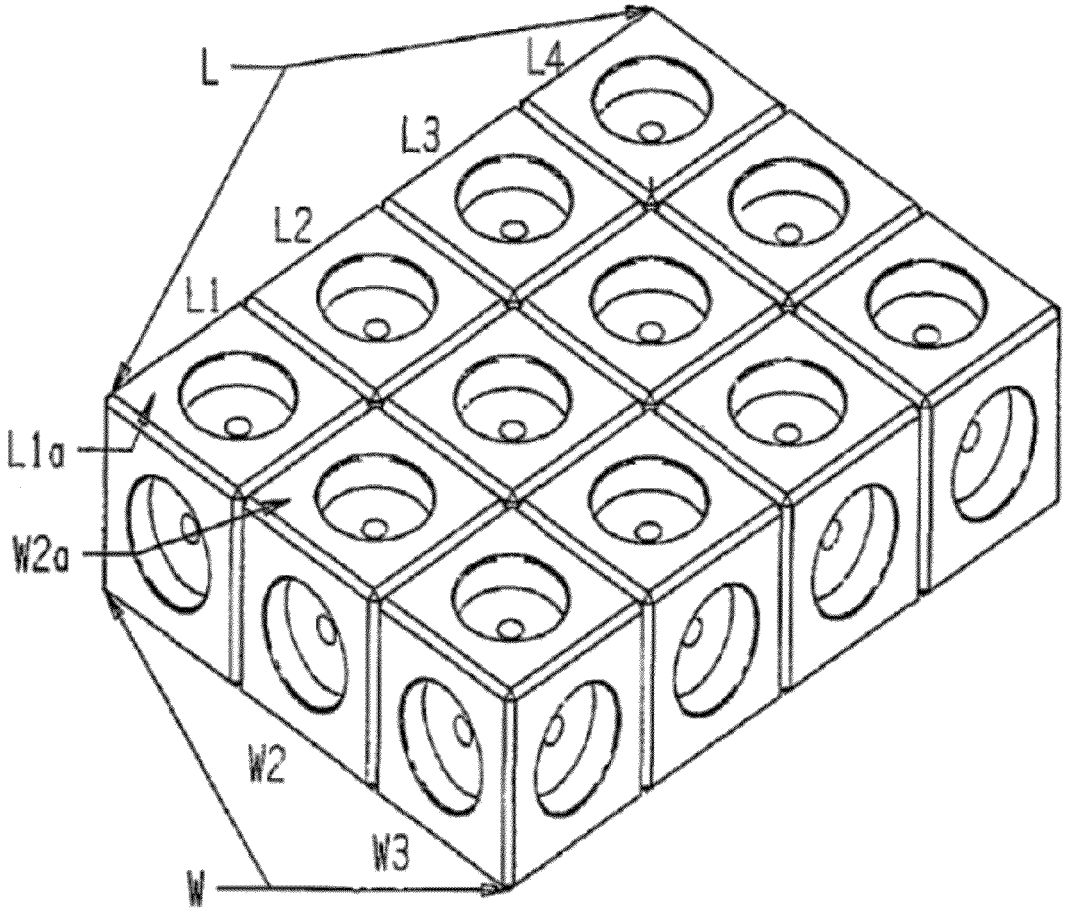
FIG. 2 shows a structure assembled from the building elements of a construction kit, in accordance with various embodiments.

Referring now to FIG. 2, an embodiment of a single plane predefined construction is shown that may be pre defined at will by a player. The pre defined construction has the shape of a cuboid with a length L of four basic building elements L1, L2, L3 and L4 and a width W of three basic building elements L1, W2 and W3. The total number of basic building elements in the pre defined construction of FIG. 2 is 12. As seen in FIG. 2, due to the beveled edges of the basic construction elements a groove with a generally triangular cross section is formed between two adjacent faces of adjacent basic building elements. Thus for example basic building element L1 has a face L1*a* that is adjacent to the face W2*a* of the basic building element W2 and between the two adjacent faces L1*a* and W2*a* a groove g with a generally triangular cross section is formed.

Having pre defined the final structure of FIG. 2, a player may proceed to assemble a set of composite building elements designed in a manner that enables the assembly of the said final structure using the said set of composite building elements. The composite building elements may be assembled using the specific number of basic building elements and connecting pieces.

It will be understood that many different designs of the composite building elements may be assembled according to the player's imagination or according to the level of difficulty he wishes to create.

Figure 3A:
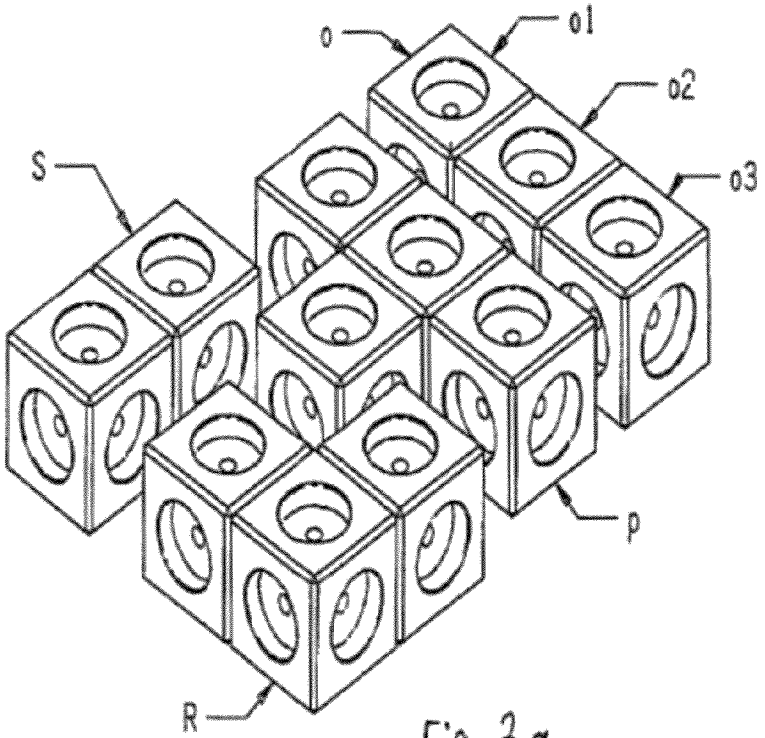
FIG. 3 shows the composite building elements used for constructing the structure of FIG. 1 in top view (3*b*) and in perspective view (3*a*), in accordance with various embodiments.
Figure 3B:
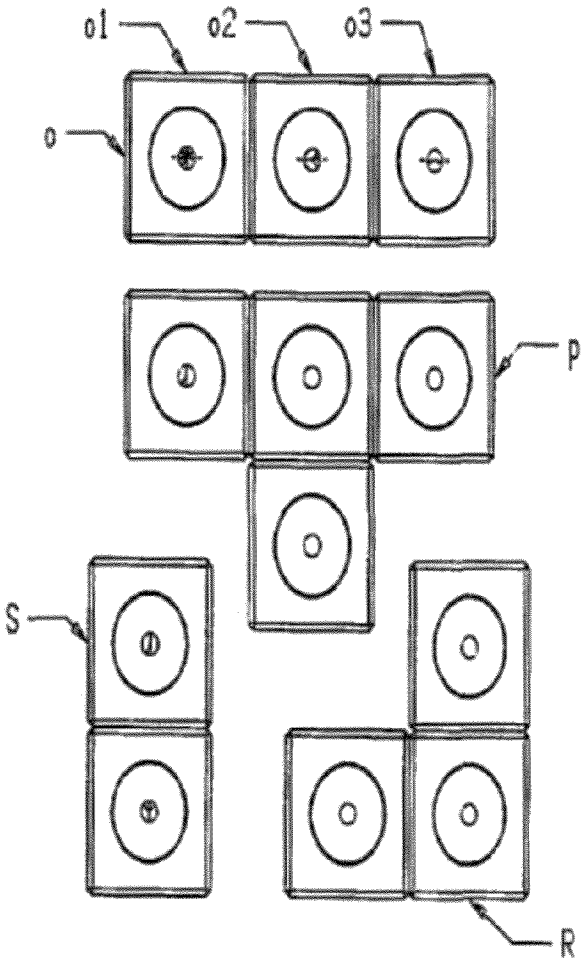

FIG. 3 shows one example of an embodiment with a set of composite building elements that may be used in the assembly of the final structure of FIG. 2, including four composite building elements of different designs 0, P, R, and S chosen at will by a player wherein 3*a* is a perspective view and 3*b* is a top view of the said set of composite building elements 0, P, R and S.

The assembly of the composite building elements 0, P, R, and S may be carried out by using connecting pieces to connect the basic building elements. Thus, for example, the composite building element 0, that is an assembly of three basic building elements 01, 02 and 03 connected in a row, may be assembled by screwing the threaded stem of a first connecting piece into a bored hole on a first face of the basic building element 01, inserting the cylindrical head of the said first connecting piece into a cylindrical depression on a first face of the basic building element 02 such that it is tightly received in the said cylindrical depression, then screwing the threaded stem of a second connecting piece into the face of the basic building element 02 that is opposite and parallel to the said first face of the said basic building element 02 and inserting the cylindrical head of the said second connecting piece into a cylindrical depression on a first face of the basic building element 03 such that it is tightly received in the said cylindrical depression. Other embodiments may include basic and/or composite building elements and connecting pieces or connecting means with different connecting configurations, some of which are discussed below and shown in the figures that may be used to create composite elements. Some embodiments may allow for more or less or players to participate.

Composite building element P may be a generally T shaped structure assembled of four basic building elements using three connecting pieces in the manner that was described above for composite building element 0, while composite building element R may be an L shaped structure assembled from three basic building elements A using two connecting pieces and composite building element S is a simple assembly of two basic building elements A connected by a single connecting piece, merely by way of example As seen in FIG. 3, the composite building elements 0, P, R and S may be first assembled without any connecting pieces on their outer faces. Following assembly of the composite building elements 0, P, R and S, connecting pieces may be added to the composite building elements 0, P, R and S by screwing the stems of a pre defined number of connecting pieces M into bored holes at pre defined locations on the outer faces of the composite building elements 0, P, R and S. A player may be capable of planning in advance the location of the connecting pieces such that assembly of the composite building elements 0, P, R and S into the pre defined final structure of FIG. 2 is facilitated. The connecting pieces may be relocated in the event that the player is not satisfied with the result for any reason or in the event that the positions of the connecting pieces or any of them are found to obstruct the assembly of the final construction. Other embodiments may include basic and/or composite building elements and connecting pieces or connecting means with different connecting configurations, some of which are discussed below and shown in the figures that may be used to create composite elements. Some embodiments may allow for more or less or players to participate.

Figure 4A:
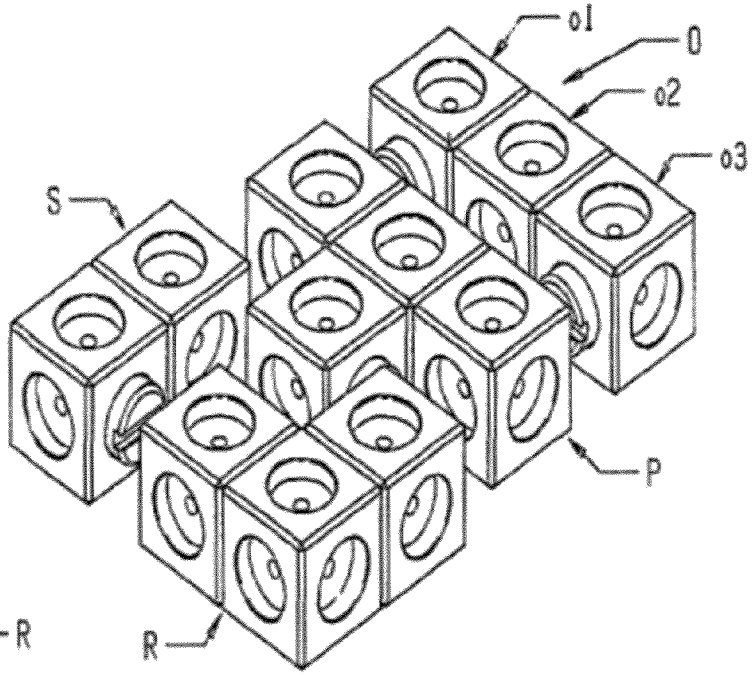
FIG. 4 shows in top view (4*b*) and in perspective view (4*a*) the composite building elements of FIG. 3 with connecting pieces introduced into the said composite building elements, in accordance with various embodiments.

FIG. 4 shows one example of an embodiment of an arrangement of the connecting pieces M on the composite building elements 0, P, R and S that enables the assembly of the final structure of FIG. 2. It will be understood that the drawing on the right side of FIG. 4, generally designated 4*a*, shows the set of composite building elements 0, P, R and S in perspective view while the drawing on the left side of FIG. 4, generally designated 4*b*, shows the set of composite building elements 0, P, R and S in top view.

Figure 4B:
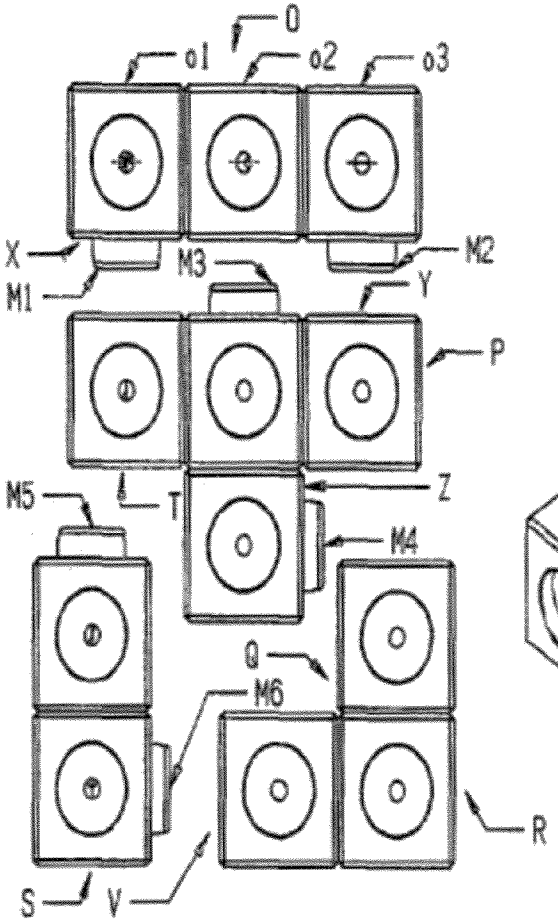

As seen in FIG. 4*b*, in the example of FIG. 4 composite building element has two connecting pieces M1 and M2, located in the cylindrical depressions on a face X of the said composite building element 0. The connecting pieces M1 and M2 may enable the player to attach the composite building element to the composite building element P by pushing the cylindrical heads of the connecting pieces M1 and M2 into cylindrical depressions in the face Y of the composite building element P. At the same time the cylindrical head of the connecting piece M3 that is abutting from the said face Y of the composite building element P may be pushed into a cylindrical depression in the face X of the said composite building element 0.

Looking again at FIG. 4, on a face Z of the said composite building element P a further connecting piece M4 is located that may enable the attachment of composite building elements P and R by pushing the cylindrical head of the said connecting piece M4 into a cylindrical depression in the face Q of the composite building element R. It will be understood however that once the composite building element R is attached to the composite building element P, it may be impossible to complete the final structure of FIG. 2 due to the position of the connecting pieces M5 and M6 on the composite building element S. As seen in FIG. 4*b*, the connecting piece M5 is disposed in an orientation that is perpendicular to the orientation of the connecting piece M6. Each of the said connecting pieces M5 and M6 may be allowed to move freely along an adjacent composite building element while the other connecting piece is being pushed into the respective cylindrical depression that is designed to receive it. Thus while the connecting piece M5 may be pushed into the cylindrical depression in the face T of the composite building element P the connecting piece M6 must be free to move in the direction of the said face T of the composite building element P. This may not be achieved in the event that the composite building element R is already attached to the composite building element P. In this latter case the face U of the composite building element R will hinder the movement of the composite building element S due to the protrusion of the connecting piece M6 from the face of the said composite building element S.

The above embodiment is just a simple example of the obstacles and limitations that may be presented to a player who may invited to take apart the final structure of FIG. 2 and rebuild it without altering the configuration of the basic building elements 0, P, R and S, the number of connecting pieces on the said basic building elements 0, P, R and S or the mode of distribution of the said connecting pieces M1, M2, M3, M4, M5 and M6 on the said basic building elements 0, P, R and S. Other embodiments may include basic and/or composite building elements and connecting pieces or connecting means with different connecting configurations, some of which are discussed below and shown in the figures that may be used to create composite elements. Some embodiments may allow for more or less or players to participate.

Figure 5A:
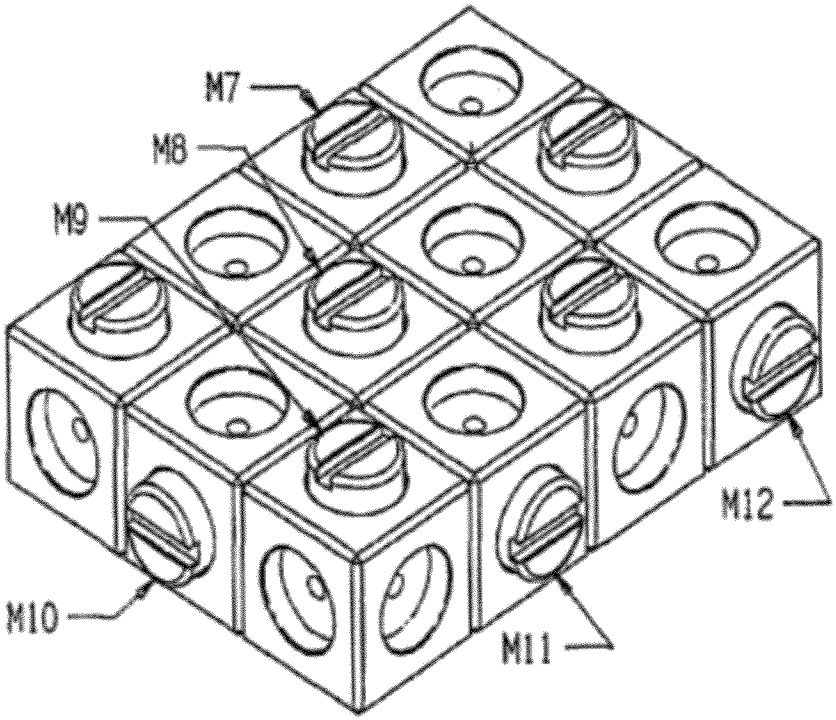
FIG. 5 shows the structure of FIG. 2 after assembly in top view (5*b*) and in perspective view (5*a*), with connecting pieces introduced into the outer faces of the said structure creating a pattern on the said outer faces of the said structure, in accordance with various embodiments.
Figure 5B:
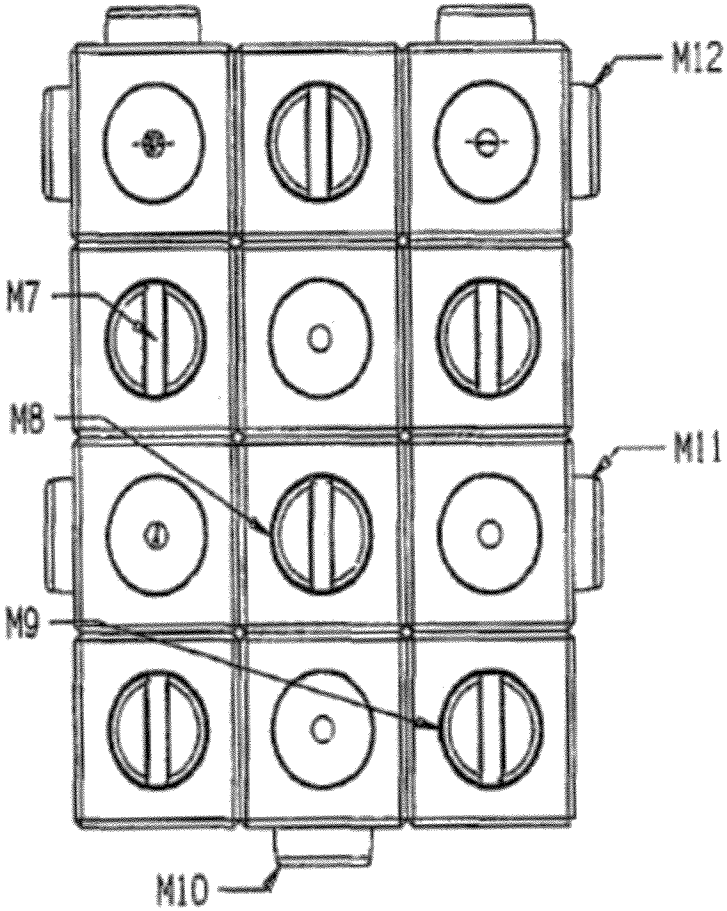

Looking now at FIG. 5 wherein drawing 5*b* is a top view of drawing 5*a*, a pattern of connecting pieces in accordance with various embodiments that was added on the outer faces of the pre defined structure of FIG. 2 by the said first player is shown. The pattern of drawings 5*a* and 5*b* includes diagonal rows of connecting pieces alternating with diagonal rows of cylindrical depressions with no connecting pieces. Thus connecting pieces M7, M8 and M9 comprise a diagonal row of connecting pieces, while cylindrical depressions b1, b2, and b3 comprise a diagonal row of cylindrical depressions without connecting pieces.

It will be understood that where the final structure of drawings 5*a* and 5*b* may be presented to a player to be disassembled and reassembled into the same structure and using the same composite building elements, the number of limitations and thence the level of intellectual challenge facing the said second player is considerably elevated. It will be further understood that a player may be capable of adding connecting pieces to the said composite building elements 0, P, R and S before assembling the final structure of FIG. 5 in a manner that will result in the diagonal pattern of FIG. 5. It will be understood that embodiments that have been described hereinabove by way of example only in accordance with a some embodiment and many modifications, variations and applications of the invention exist that remain within the scope of the description and the claims.

In some embodiments, a different set of composite building elements may be devised, wherein the design of the composite building elements or some of them may be different or the positions of the connecting pieces on the faces of the said building elements may be altered such that assembling the same final structure becomes a completely different task. In some embodiments, differently designed composite building elements with different positions of connecting pieces on the faces of the said building elements may be used to build a different structure with or without a pattern on its outer face. Some embodiments enables the player to create a large variety of puzzles using the same basic building elements and connecting pieces.

In accordance with another embodiment, a construction kit may be made of a number of integral composite building elements, each integral composite building element being a solid unit having generally the same size and form as three basic building elements put together. It will be understood that solid units may also be made of two elements or four elements arranged in different ways. It will be further understood that in accordance with embodiments many different games may be played with solid units having generally the same design by creating different arrays of the connecting pieces on the faces of the said solid units.

Due to the huge variety of puzzles that may be created using the same basic building elements and the same basic connecting means, embodiments have considerable applicability as a toy, an intellectual game, a therapeutic game and a means for diagnosis or for testing intellectual development. Some embodiments may be utilized as a spatial game, being either a computer game, physical game or a combination thereof. In some embodiments, the game may be comprised in a non-limiting manner of the following playing steps (a) selecting a plurality of basic building elements being displayed as a cube or any other object having a plurality of outer faces, with a depression disposed on at least a portion of said faces and with a hole centrally disposed within at least a portion of the said depressions respectively; (b) selecting a plurality of connecting pieces, the said connecting pieces having a stem adapted to be tightly received in one of the said receiving means in a first basic building element and each of the said connecting pieces further having a head adapted to be tightly received in one of the said depressions in a second basic building element such that the said basic building elements may be interconnected by the said connecting pieces to create a composite building element; (c) selecting a number of connecting pieces adapted to be attached at selected positions on the outer faces of the said composite building elements; and (d) constructing at least one predefined structure in the manner that the said stems are tightly received in the said receiving means on the faces of the said composite building elements and the said heads are abutting from the said outer faces of the said composite building elements in a manner that may hinder or facilitate the assembly of the said composite building elements into a predefined structure whereby the said composite building elements must be arranged in a specific manner so as to enable the assembly of the said predefined structure.

Figure 6:
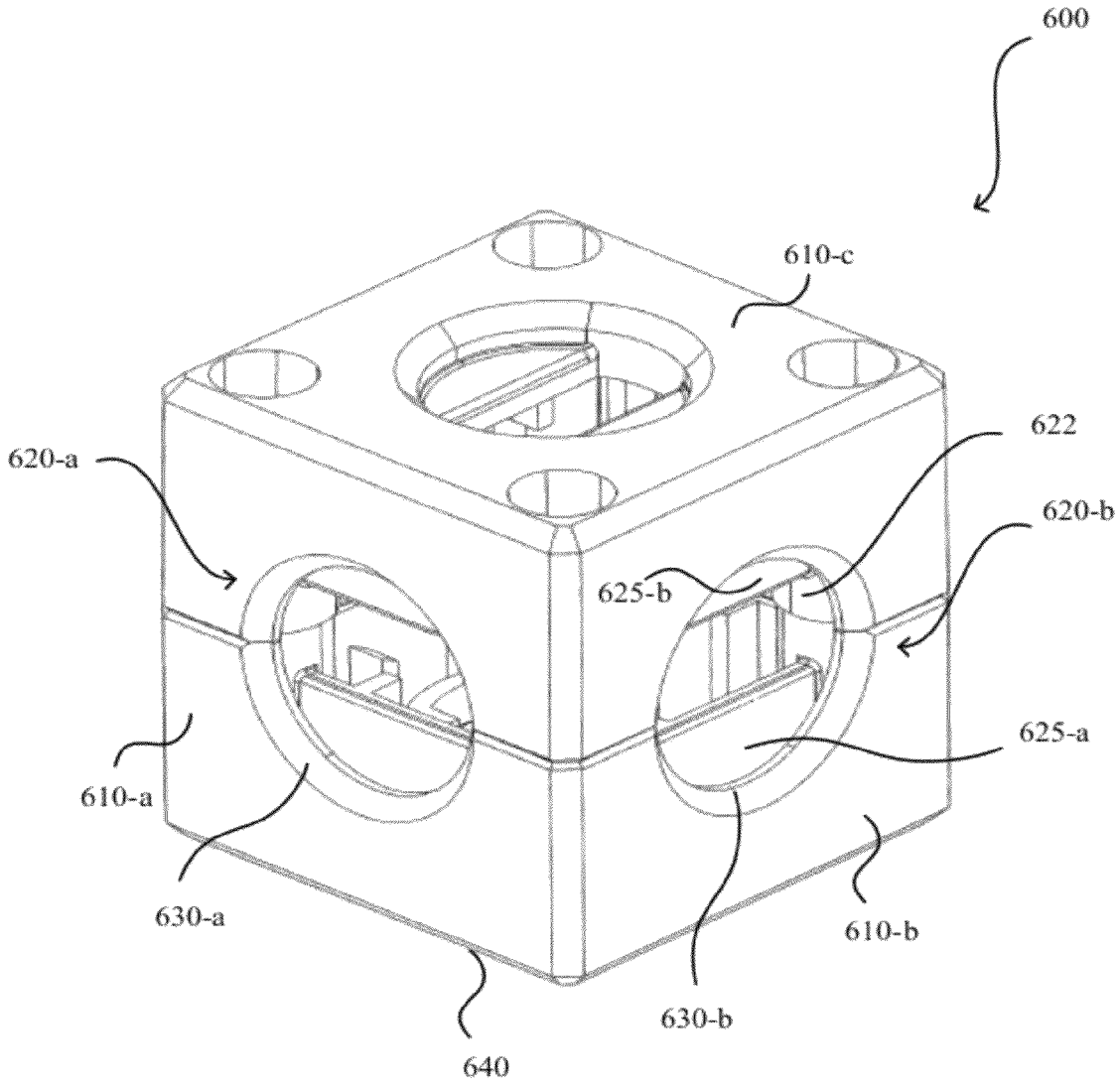
FIG. 6 shows a basic building element, in accordance with various embodiments.

Embodiments as discussed above may also include building elements that may be referred to as connector units and/or connector building elements. Embodiments may include building elements that may be referred to as receptor units and/or basic building elements. Merely by way of example, FIGS. 6, 7, 12, and 13 show examples of embodiments involving connector building elements and/or basic building elements. For example, FIG. 6 shows a basic building element 600 in accordance with various embodiments. Basic building element 600 may include one or more receptor or receiving portions 620 and multiple external faces 610. In some cases, receiving portions 620 may define an elongated opening 622, which may be defined by receiving structure 625. Receiving portions 620 may also include a depression 630 that may be circular. An elongated opening 622 may be part of the depression portion of the receiving portion. Receiving portions 620 may be configured to receiving a connector portion of a connector building element or other connector elements as discussed below. Element 600 also may include edges like 640.

Figure 7:
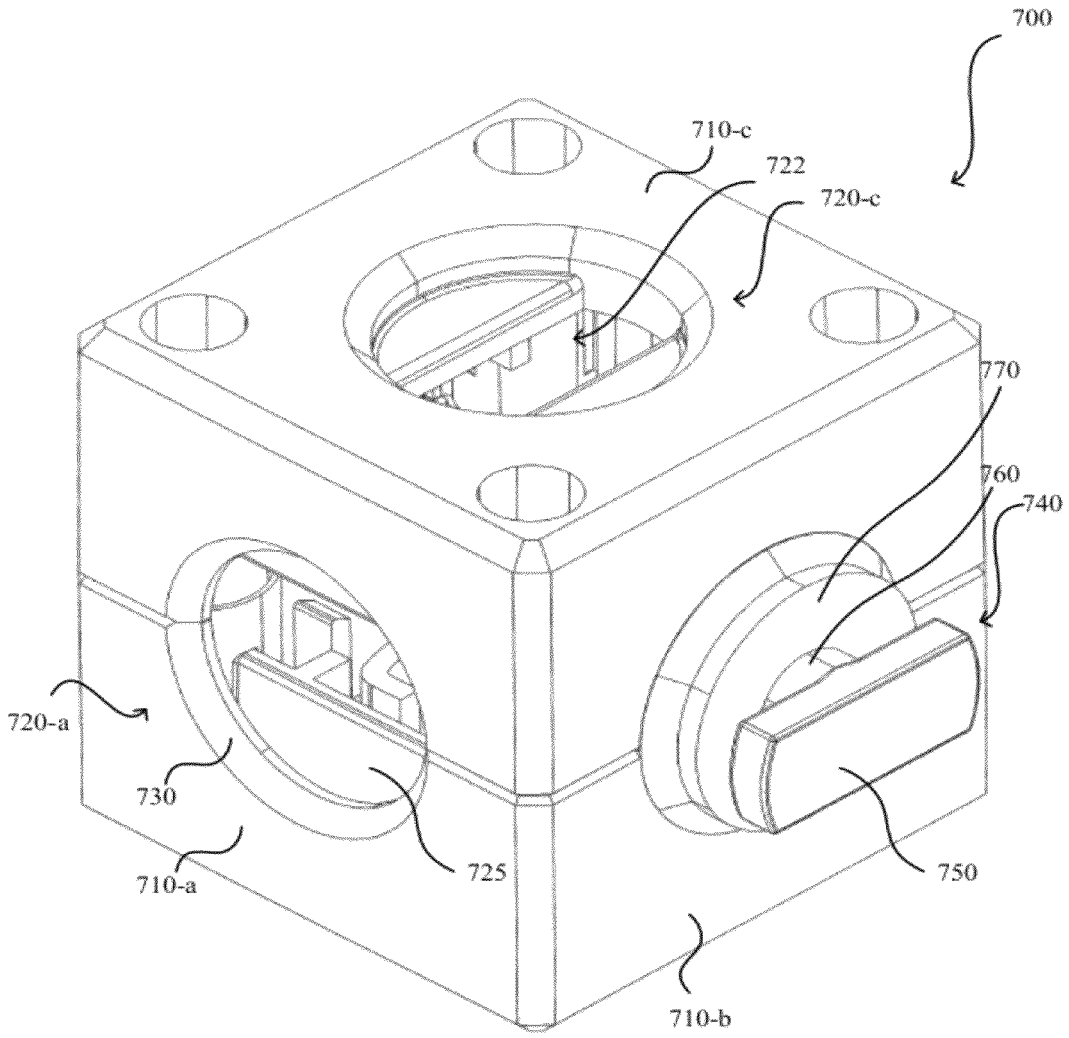
FIG. 7 shows a connector building element, in accordance with various embodiments.

FIG. 7 provides an example of connector building element 700 in accordance with various embodiments. Connector building element 700 may include one or more receptor or receiving portions 720 and one or more connector or connecting portions 740 that may be used to connect a connector building element with another element, such as a basic building element like basic building element 600 of FIG. 6 or a connector building element like connector building element 700. FIG. 7 shows a connector building element 700 that includes multiple faces 710, that are squares in this example, with multiple receiving portions 720, that may include circular depressions 730 and slots or elongated openings 722 on a face of the element, along with a connector portion 740, which may called a connecting or connector pin. Connector portion 740 may include one or more longitudinal structures 760 and one or more lateral structures 750 that may be connected at an end of one or more of the longitudinal structures 760. Longitudinal structure 760 and lateral structure 750 may form a T-shaped structure. In some embodiments, connector portions 740 may include a flange structure or platform structure 770, which may be circular and configured to fit into a circular receiving portion like 630 of FIG. 6. Lateral structures 750 may be configured to fit through a receiving portion, such as receiving portion 720, and elongated portion 722 in particular examples, of a connector building element 700 and/or receiving portion 620 of a basic building element 600 of FIG. 6.

Figure 8A:
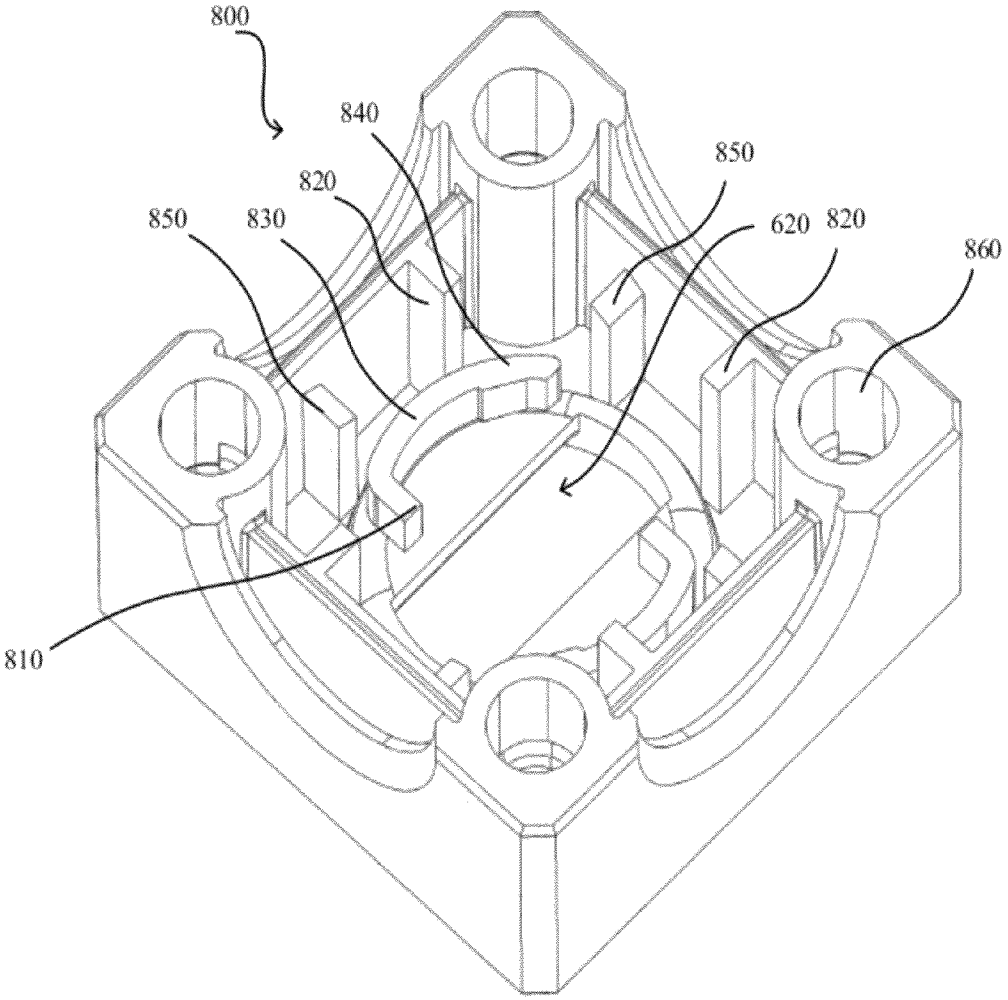
FIG. 8A shows an section of a basic building element and/or a connector building element, in accordance with various embodiments.

FIG. 8A provides a section 800 of a basic building element 600 of FIG. 6 and/or connector building element 700. FIG. 8A shows several different aspects that may aid in connecting or combining building elements, such as elements 600 and/or 700, together. For example, FIG. 8A shows multiple blocking structures 810 and 820. Blocking structures 810 and/or 820 may be configured to block a lateral structure, such as lateral structures 750 of a connector portion of a connector building element 700. Blocking structures 810 and 820 may block a lateral structure, such as lateral structure 750, such that an external face of a connector building element symmetrically aligns with a respective external face of a basic building element. This alignment may include aligning the edges of a external face of such building elements. FIG. 8A also shows receiving portions 620 as described above with respective building element 600 of FIG. 6.

FIG. 8A also shows several other structures, including locking or holding structures 830 and 850. Locking or holding structures 830 and 850 may be configured to maintain a lateral structure, such as lateral structure 750, in a position such that the respective external face of a connector building element aligns with a respective external face of a basic building element. Locking structure 850 provides a structure with a first length that may be shorter than a blocking structure 820. Locking structure 850 and blocking structure 820 may be parallel to each other and work together to hold a lateral structure to maintain alignment between respective faces of building elements. Another locking or holding structure is show in FIG. 8A. For example, locking structure 830 may aid in holding a lateral structure in a position when external faces of building elements are aligned. Blocking structure 810 may aid in this alignment process. In addition, internal ramp structure 840 may be coupled with locking structure 830 in some cases. Internal ramp structure 840 may include a portion with a first width such that a lateral structure receives a compressive force when the lateral structure is rotated by the first width. Internal ramping structure 840 may be combined with locking structure 830, where locking structure 830 has a second width such that a lateral structure is held or locked into a position when external faces and/or edges of building elements are aligned. Section 800 also includes locking receiving structures 860 that may be utilized to combine section 800 with another section to form a complete building element.

Figure 8B:
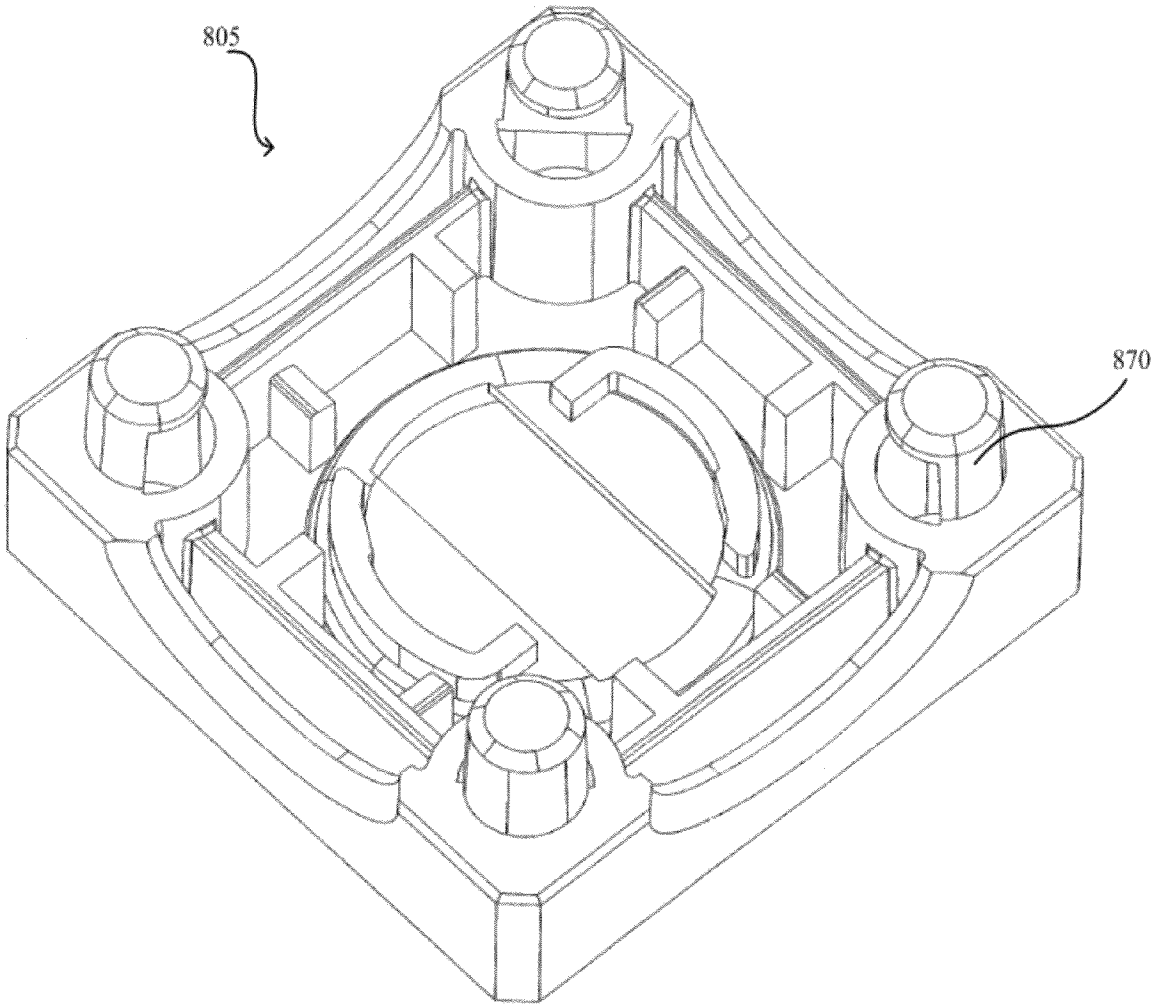
FIG. 8B shows another section of a basic building element and/or a connector building element, in accordance with various embodiments.

FIG. 8B shows another example of a section 805 of a basic building element 600 of FIG. 6 and/or connector building element 700. Along with including numerous features discussed above with respect to FIG. 8A, in this case, section 805 includes multiple locking post structures 870 that may couple with locking receiving structure 860 to connector two sections of a building element.

Figure 9:
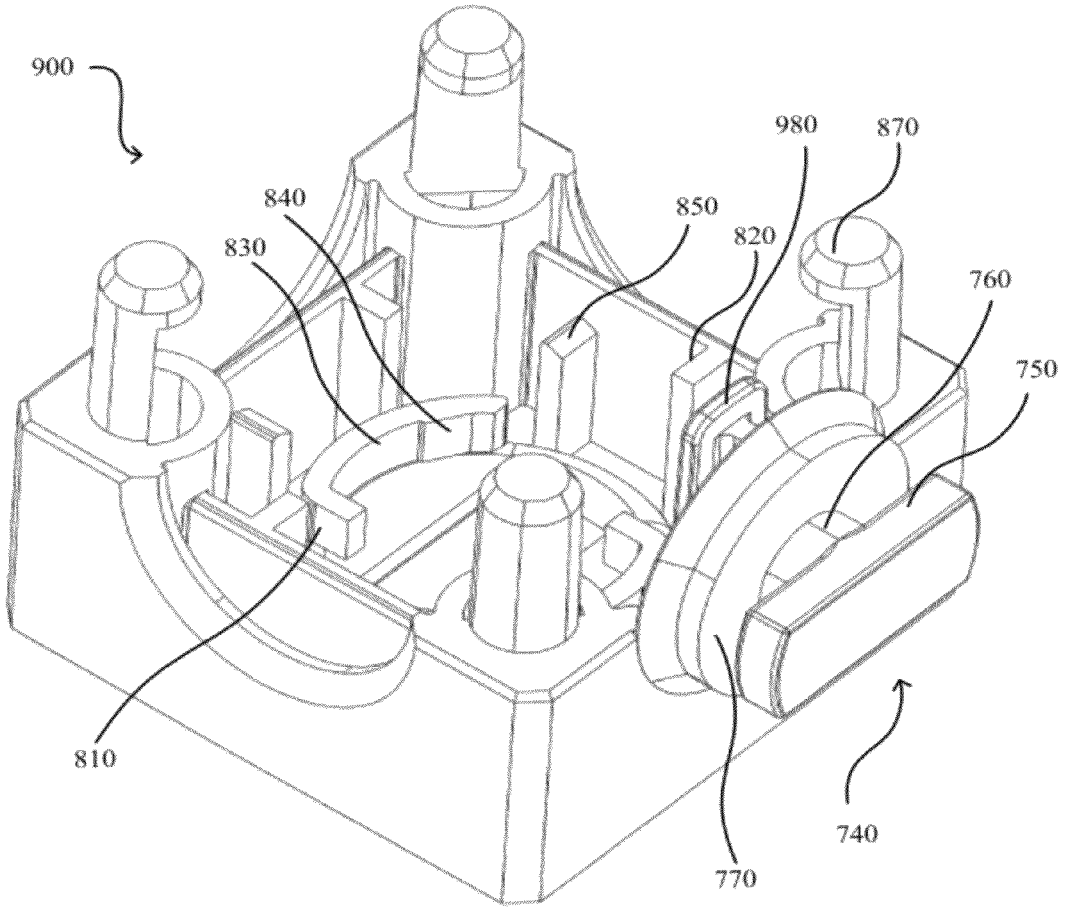
FIG. 9 shows a section of a connector building element, in accordance with various embodiments.

FIG. 9 provides a section 900 of a connector building element 700 of FIG. 7. FIG. 9 includes numerous structures and/or aspects that are similar or the same as found in FIGS. 8A and 8B. For example, FIG. 9 includes blocking structures 810 and 820, locking structures 830 and 850, and internal ramp structure 840, along with locking post structure 870. These structures are all discussed above with respect to FIGS. 8A and 8B. In addition, section 900 includes connector or connecting portion 740, as discussed above with respect of FIG. 7, including lateral structure 750, longitudinal structure 760, and flange structure 770. Further, section 900 shows an I-beam structure 980, which may be included to provide structural support when combining section 900 with a section like section 800 of FIG. 8A.

In some embodiments, a connector building element and a basic building element or connector building element may be coupled together to form a combined unit or puzzle segment, which may also be referenced as composite building elements, that may be used as part of a puzzle, puzzle configuration, or for other purposes. In some embodiments, a connecting pin or connecting portion, such as 740, in general of a connector building element, such as 700, may be inserted into a receptor or receiving portion of a basic building element, such as 600, or connector building element, such as 700. In some embodiments, the receptor portion may include a slot and/or elongated portion that may also include a circular depression in the face of a receptor unit. The connector unit and/or the receptor unit may then be rotated to couple the elements together. The units or elements may be rotated to a pre-determined position and/or angle. Merely by way of example, the elements may be rotated by 90 degrees, 120 degrees, or 180 degrees in some embodiments. In some cases, an orientation of an elongated opening may determine by what angle elements may need to be rotated with respect to each other to result in aligned elements. Some embodiments may also utilize different shaped elements besides cubic-like elements, as generally shown in the figures. Some embodiments may utilize different shaped elements with faces including, but not limited to, rows of cubes, trapezoids, tetrahedrons, and pyramids.

Figure 10A:
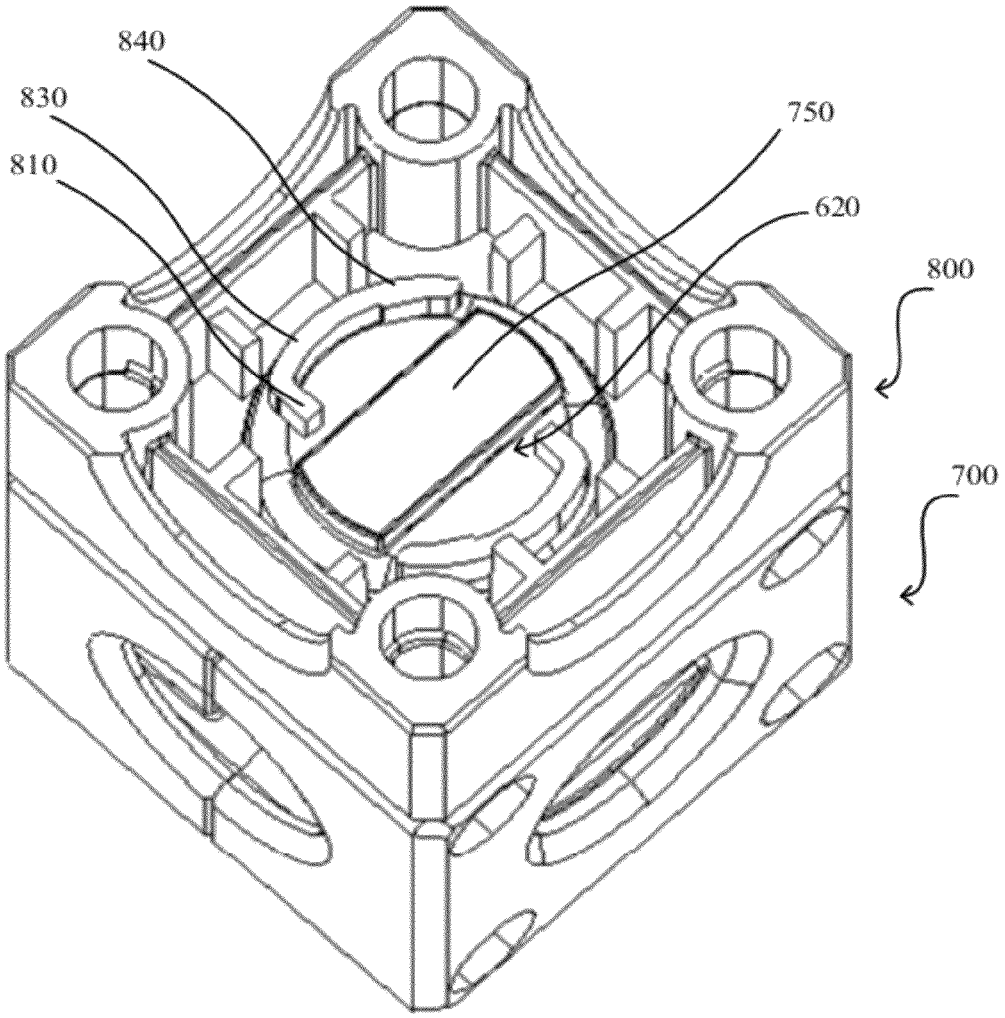
FIGS. 10A-C show a process of connecting or combining a connector building element with a connector building element or a basic building element, in accordance with various embodiments.
Figure 10B:
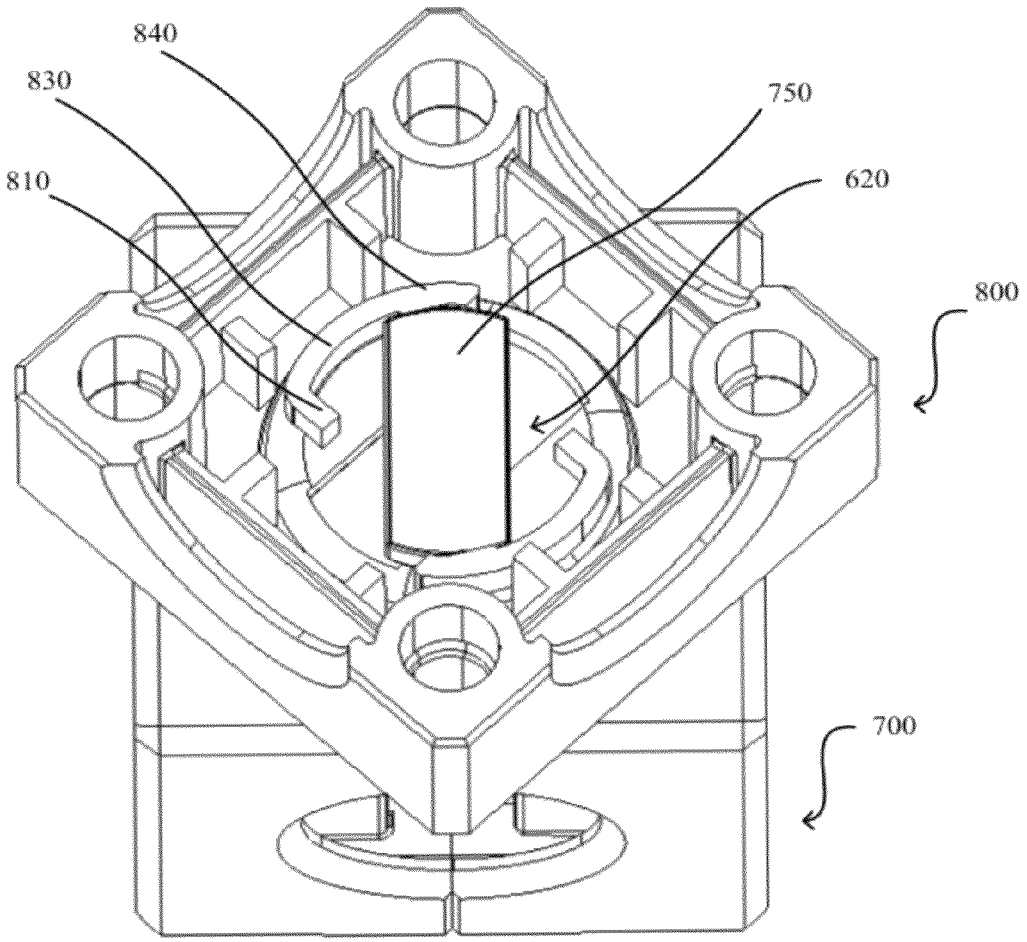
Figure 10C:
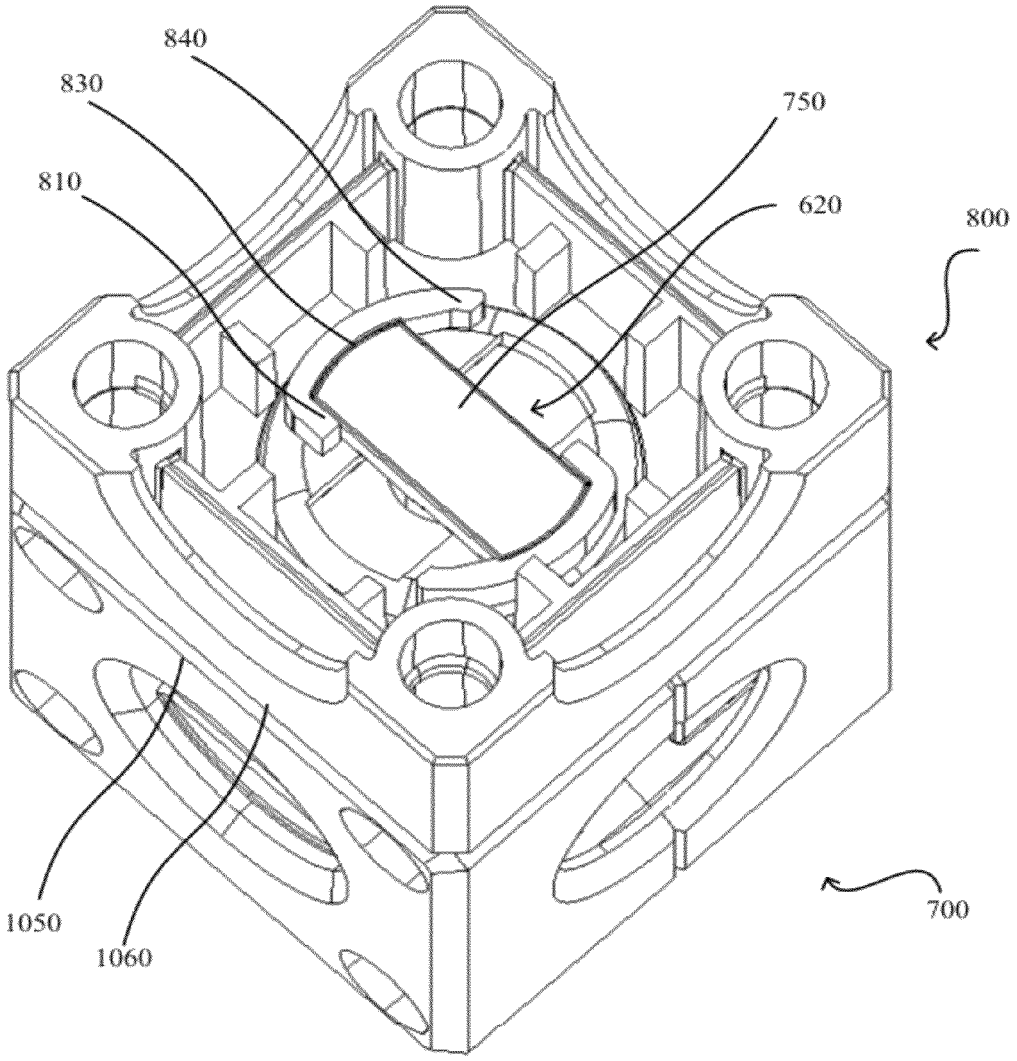

FIGS. 10A, 10B, and 10C show one possible process or method for connector elements, such as a connector building element and a basic building element. A connector building element 700, like that seen in FIG. 7 is provided, along with a internal section portion 800, such as that seen in FIG. 8, which may be part of a basic building element 600 and/or a connector building element 700 of FIG. 7. This view is merely provided to show how the different structures relate when combining elements. In general, section 800 could be combined with a section such as section 805 or section 900 of FIG. 8B and FIG. 9 respectively to form a complete building element. In FIG. 10A, lateral structure 750 of connector building element 700 is received in receptor or receiving portion 620 of section 800. In FIG. 10 B, lateral structure 750 along with connector building element 700 and receiving portion 620 along with section 800 are rotated with respect to each other. As can be seen, lateral structure 750 is pushed against internal ramp structure 840, creating a compressive force against lateral structure 750. In FIG. 10C, lateral structure 750 is rotated until meeting blocking structure 810, along with being held in place by locking structure 830 and internal ramp structure 840. As can be seen, connector building element 700 and section 800 are aligned when lateral structure 750 meets blocking structure 810. The alignment may be described as the respective faces of connector building element 700 being aligned with a respective face of section 800. In addition, this alignment may be described as a respective edge, such as edge 1050, of connector building element 700 is aligned or parallel with respective edge, such as edge 1060, of section 800. The alignment may also be referred to as a symmetrical alignment.

The connecting pin or connector portion and/or the receiving building element may be configured such that connector building element and the receiving building element, such as basic building element or connector building element, are hindered from rotating further when respective faces of the connector unit and/or receptor unit are aligned. In some embodiments, a detent may be utilized to arrest or resist further rotation of the units. In some embodiments, rotation may be hinder when a portion of the connector portion is block by a portion of the basic building element. In some embodiments, the connector pin or connector portion may have portions that fit tightly into receiving portions of the receptor unit such that the receptor unit and the connector unit remain aligned. Some embodiments may include a tongue and groove configuration to facilitate this alignment maintaining property. Other means may also be utilized, including, but not limited to magnet segments and/or mechanical fasteners.

Figure 11A:
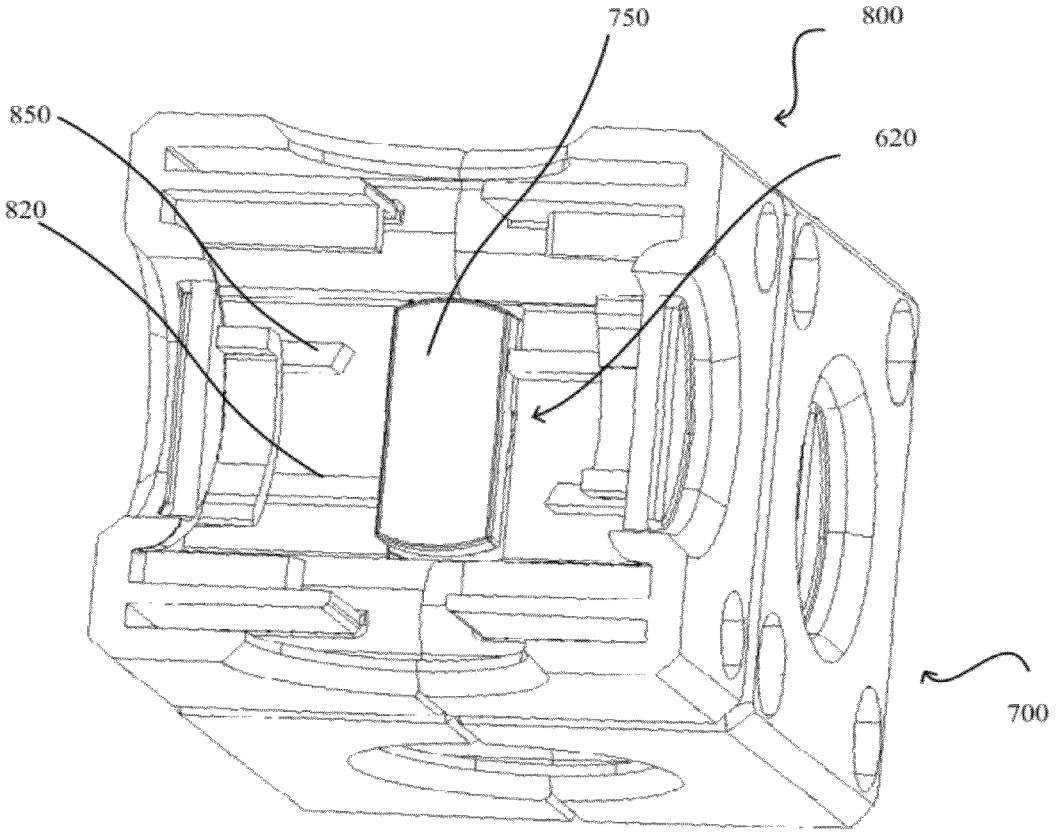
FIGS. 11A-C show another process of connecting or combining a connector building element with a connector building element or a basic building element, in accordance with various embodiments.
Figure 11B:
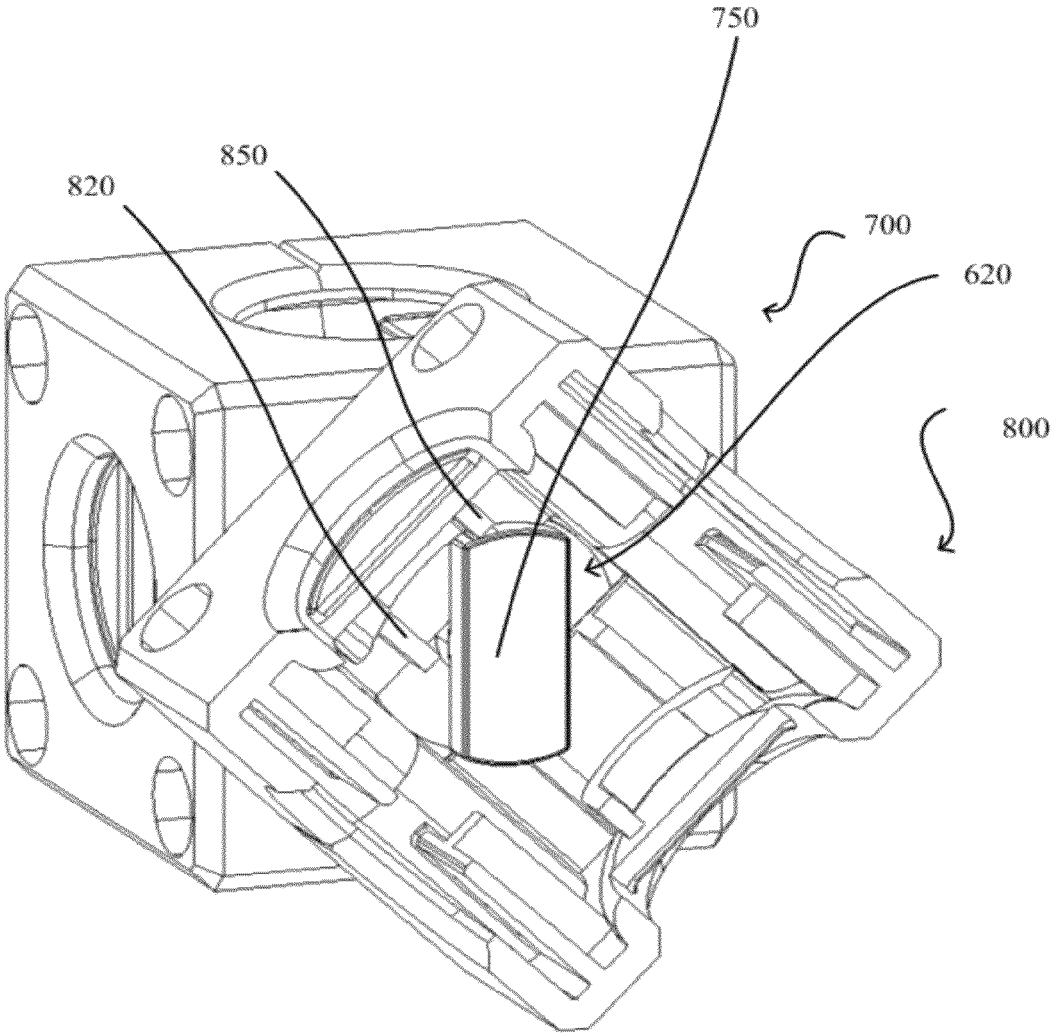
Figure 11C:
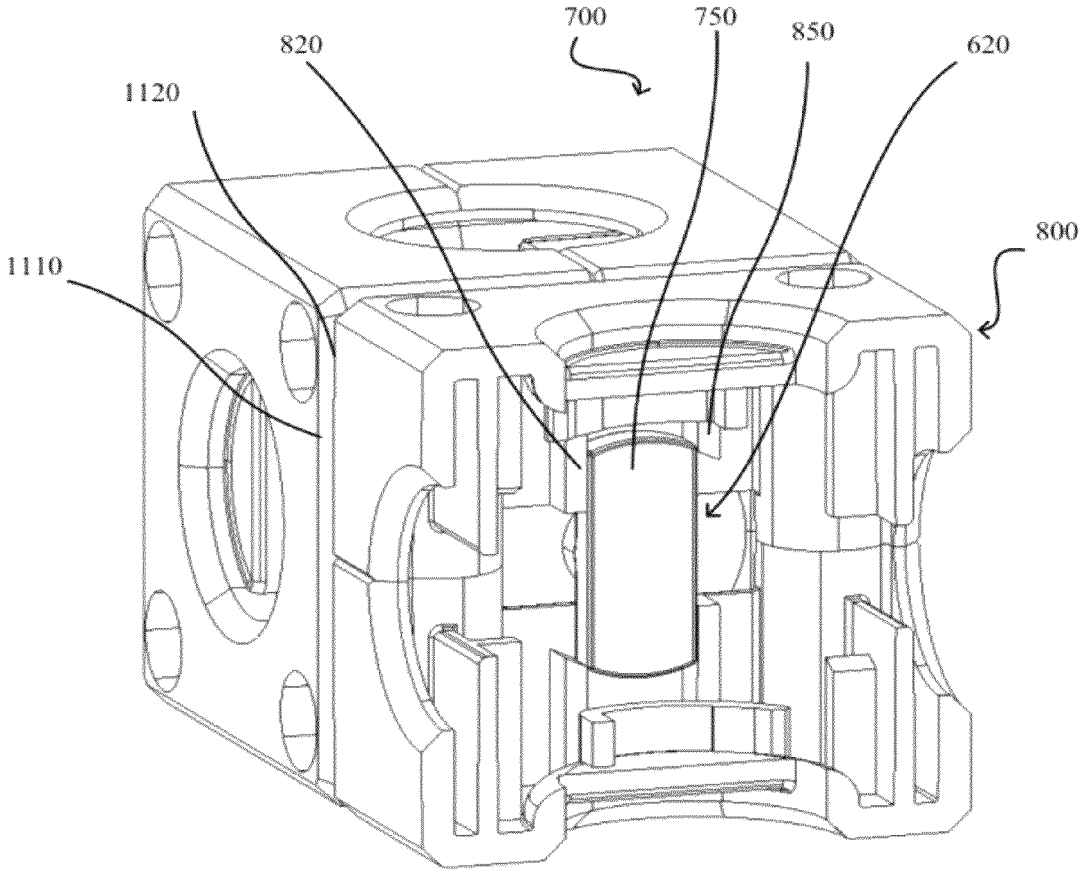

FIGS. 11A, 11B, and 11C show another possible process for connecting elements, such as a connector building element and/or a basic building element. A connector building element 700, like that seen in FIG. 7 is provided, along with a internal section portion 800, such as that seen in FIG. 8. This view is merely provided to show how the different structure relate when combining elements. In general, section 800 could be combined with a section such as section 805 or section 900 of FIG. 8B and FIG. 9 respectively to form a complete building element. In FIG. 11A, lateral structure 750 of connector building element 700 is received in receptor or receiving portion 620 of section 800. In FIG. 11B, lateral structure 750 along with connector building element 700 and receiving portion 620 along with section 800 are rotated with respect to each other. As can be seen, lateral structure 750 is pushed against locking structure 850, which may also act as an internal ramp structure, creating a compressive force against lateral structure 750. In FIG. 11C, lateral structure 750 is rotated until meeting blocking structure 820, along with being held in place by locking structure 850. As can be seen, connector building element 700 and section 800 are aligned when lateral structure 750 meets blocking structure 820. The alignment may be described as the respective faces of connector building element 700 being aligned with a respective face of section 800; this may be referred to as symmetrical alignment. This alignment may be described as a respective edge, such as edge 1110, of connector building element 700 being aligned or parallel with another respective edge, such as edge 1120, or section 800.

Figure 12:
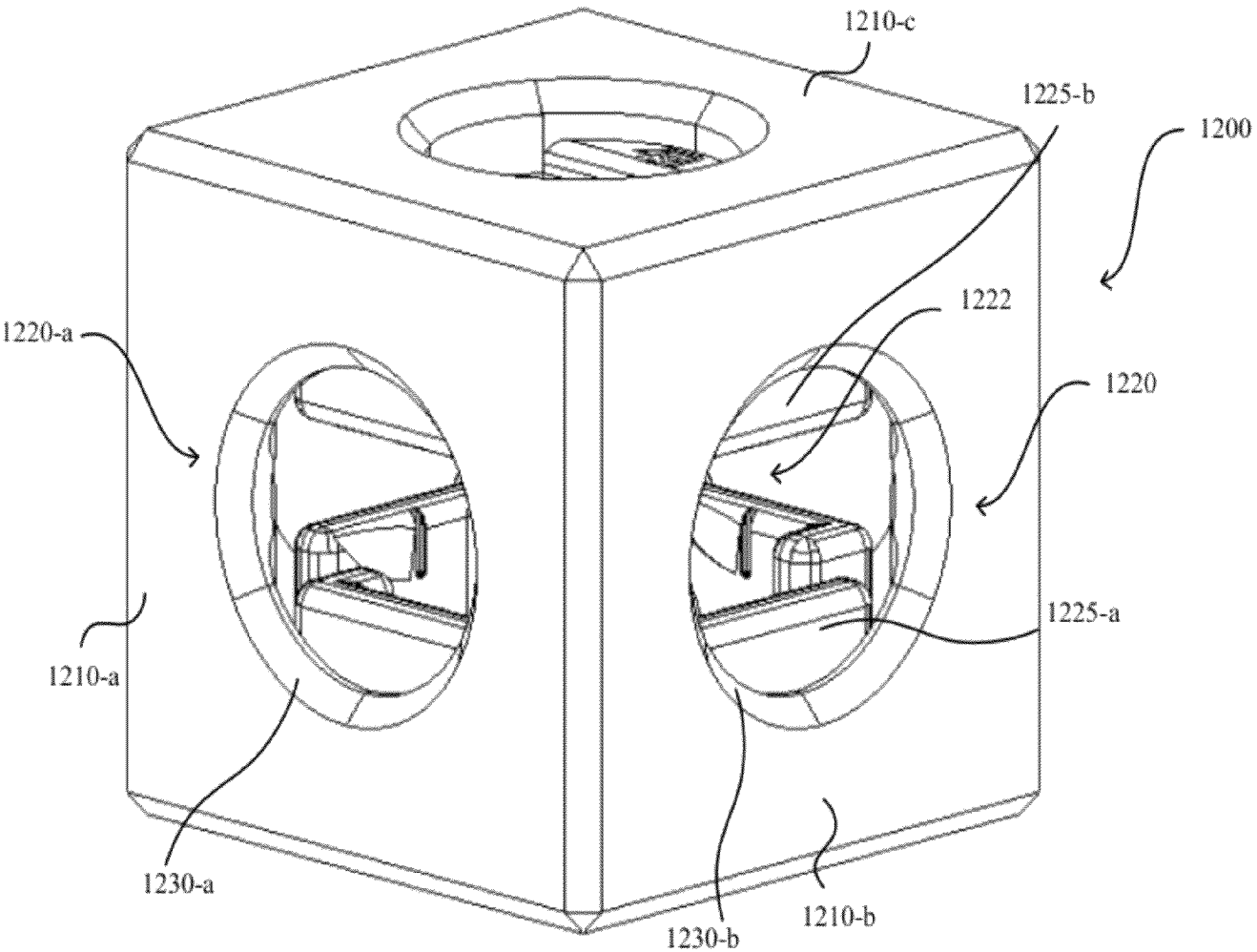
FIG. 12 shows another example of a basic building element, in accordance with various embodiments.

FIG. 12 shows another example of a basic building element 1200 in accordance with various embodiments. Basic building element 1200 may include features similar or the same as found with basic building element 600 of FIG. 6. For example, basic building element 1200 may include one or more receiving or receptor portions 1220 and multiple external faces 1210, similar to receptor or receiving portions 620 and external faces 610 of FIG. 6, respectively. In some cases, receiving portions 1220 may define an elongated opening 1222, which may be defined by receiving structures 1225. Receiving portions 1220 may also include a depression 1230 that may be circular. An elongated opening 1222 may be part of the depression portion of the receiving portion 1220. Receiving portions 1220 may be configured to receiving a connector portion of a connector building element or other connector elements as discussed above and below.

Figure 13:
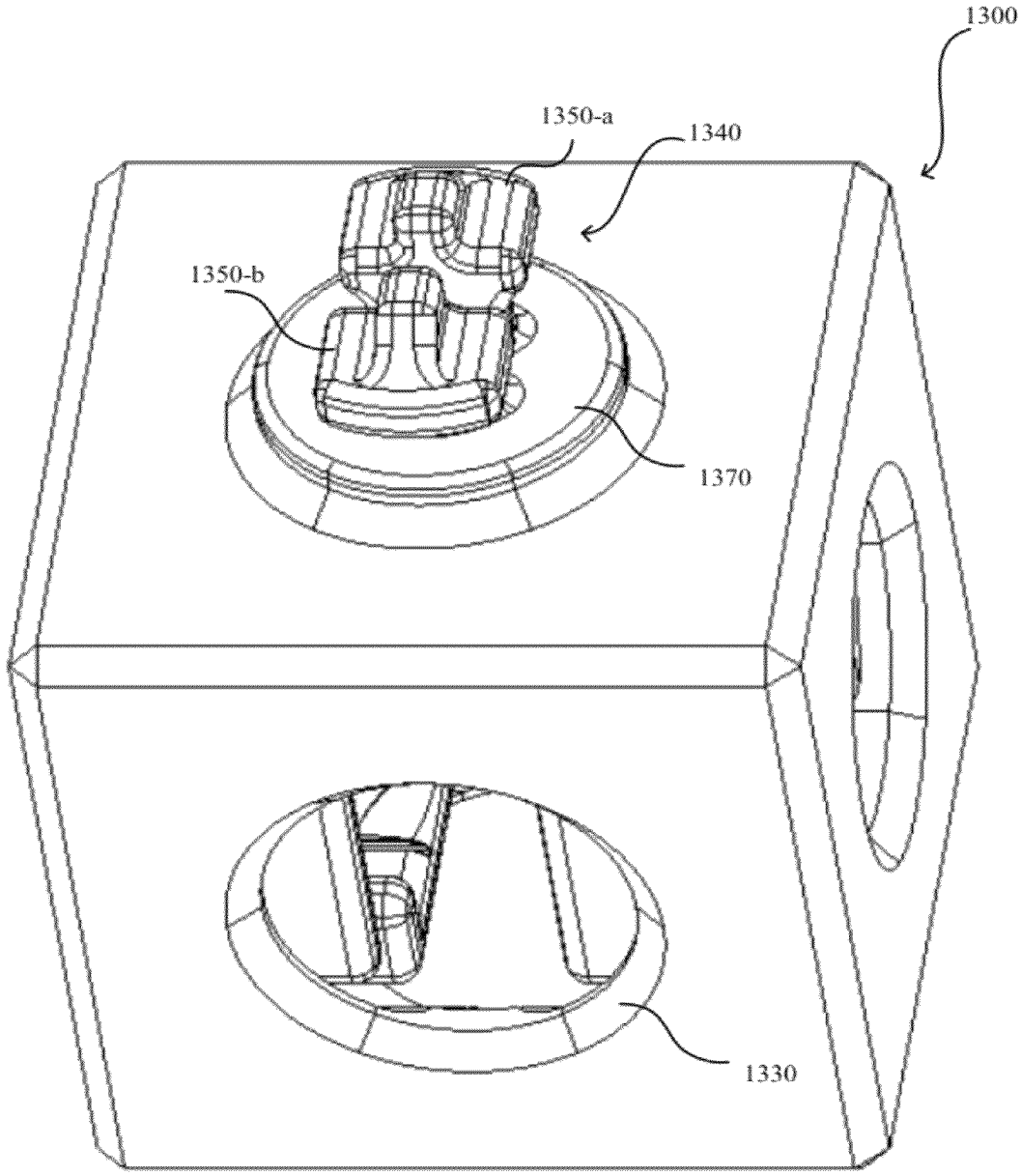
FIG. 13 shows another example of a connector building element, in accordance with various embodiments.

FIG. 13 provides an example of a connector building element 1300 in accordance to various embodiments. Connector building element 1300 may include one or more connecting or connector portions 1340, which may be referred to as connecting pieces in some cases. In some embodiments, a connecting element may be a separate element, distinct from the connector building element, where such a separate connecting elements may be configured to couple with or a to connector and/or basic building elements.

Figure 14:
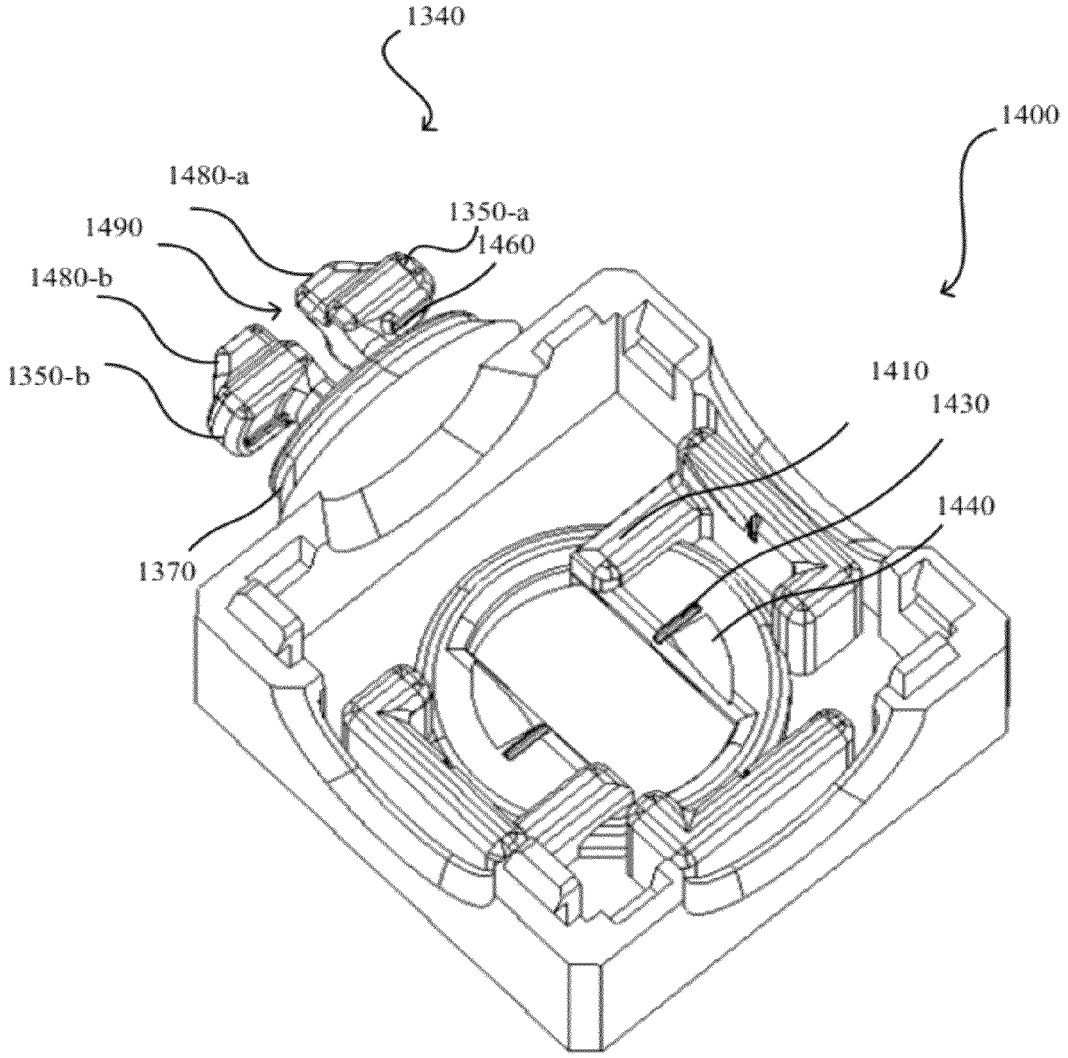
FIG. 14 shows a section of a connector building element, in accordance with various embodiments.

In some embodiments, connector building element may include a two or more lateral structures 1350. FIG. 14 shows a section 1400 of connector building element 1300 of FIG. 13 that also shows these lateral structures 1350. These connecting portions 1340 may be described as including two inverted L-shape portions that may insert into a receptor or receiving portion of a building element. The inverted L-shape portions may be separated by a gap 1490. In some embodiments, gap 1490 along with protrusions 1480 may facilitate using the connector portion as a tool for the construction of different puzzles using connector and/or receptor units, as will be described in more detail below. The L-shape portions 1350 may come in different widths and thickness. In some embodiments, a T-shaped portion may be used as seen in FIG. 7, for example. Other embodiments may include other connecting element shapes or numbers of elements. Merely by way of example, four L-shaped portions may be used to create a cross-shaped connecting element. In some embodiments, two T-shaped elements may form other cross-shaped connecting element. Other possibilities include, but are not limited, to connecting elements with only 1 L-shape portion or 3 L-shape portions.

Some embodiments may also include a platform or flange 1370, shown in both FIGS. 13 and 14, upon which the connector structures are attached or coupled. In some embodiments, platform 1370 may fit into a depression, such as circular depression 1330, in the face of a connector and/or basic building element into which a connecting element is being inserted. Platform 1370 portion may facilitate alignment and rotation of the elements with respect to each other during assemblage of different elements into multi-element segments, such as for the creation of a multi-segment and/or multi-unit puzzle. Some embodiments may also include protrusions 1480, which may be utilized to connect blocking or protrusion elements, as discussed below.

FIG. 14 also shows blocking structure 1410, locking structure 1430, and internal ramp structure 1440. These types of structures are discussed above in general, and also below with respect to a building element.

Figure 15:
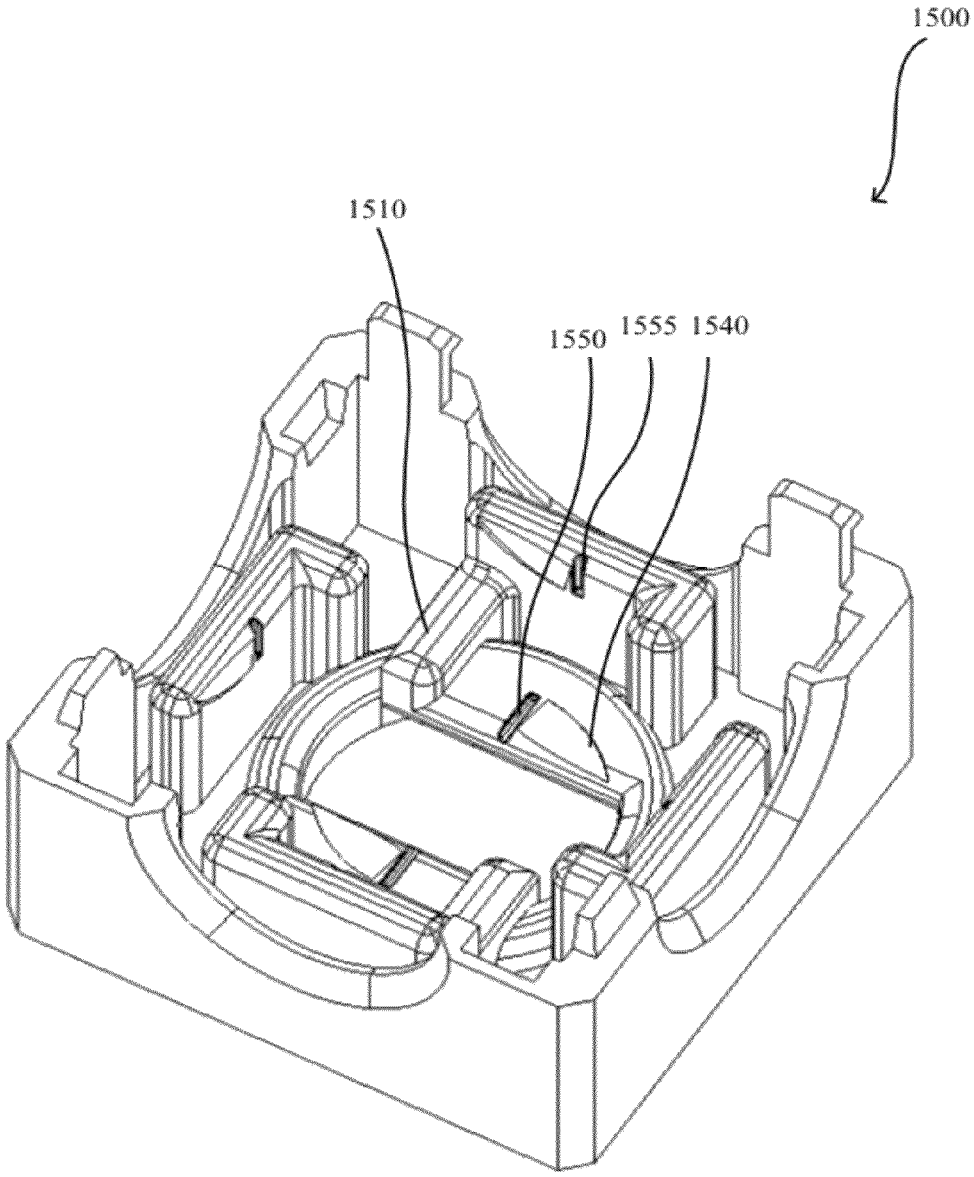
FIG. 15 shows a section of a basic building element and/or a connector building element, in accordance with various embodiments.

FIG. 15 shows a section 1500 that may be combined with a section similar to section 1500 to form a basic building element such as element 1200 of FIG. 12, or combined with a section like section 1400 of FIG. 14 to form a connector building element such as 1300 of FIG. 13. Section 1500 shows several structures, including locking or holding structure 1550 and 1555. Locking or holding structures 1550 and/or 1555 may be configured to maintain a connecting structures, such as lateral structures 1350 of FIGS. 13 and/or 14, in a position such that the respective external face of a connector building element aligns with a respective external face of a basic building element. Locking structure 1550 and/or 1555 may define a groove that may receive a tongue structures found coupled with lateral structures 1350 of FIGS. 13 and/or 14. FIG. 15 also shows blocking structure 1510 that may aid in this alignment process. Lateral structures 1350 of FIGS. 13 and/or 14 may be blocked from rotating further by blocking structure 1510, resulting in alignment of building elements that are combined. In addition, FIG. 15 shows an internal ramp structure 1540. Internal ramping structure 1540 may be combined with locking structure 1550 such that a lateral structure is held or locked into a position when external faces of building elements are aligned.

Figures 16A, 16B, 16C, 16D, 16E, 16F, 16G:
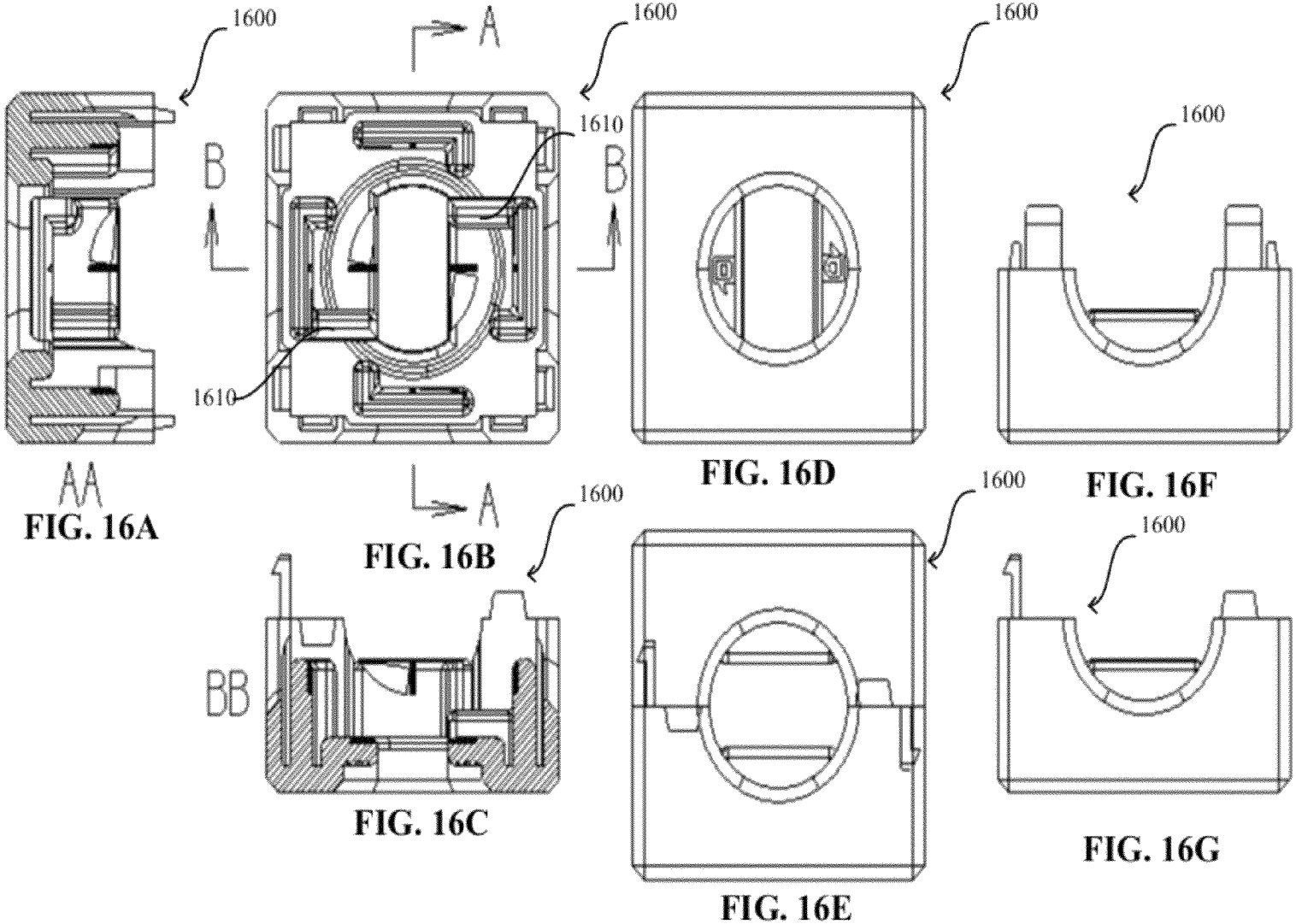
FIGS. 16A-G show several different perspectives on sections of basic building elements, in accordance with various embodiments.

FIGS. 16A-G provide several different perspectives on basic building block 1200. For example, FIGS. 16A and 16B provide perspectives on a section 1600 of a basic building element 1200 of FIG. 12 and/or connector building element discussed above. FIG. 16A shows a side view of 1600, while FIG. 16B shows an internal top down view of 1600. Several different aspects of section 1600 may aid in connecting building elements. For example, FIG. 16B shows multiple blocking structures 1610. Blocking structures 1610 may be configured to block a lateral structure, such as lateral structure 1350 of a connector portion of a connector building element 1300. Blocking structures 1610 may block a lateral structure, such as lateral structure 1350, such that a external face of a connector building element aligns with a respective external face of a basic building element. This alignment may include aligning the edges of a external face of such building elements and may be referred to as symmetrical alignment in some cases. FIG. 16C shows another side view of section 1600. FIG. 16D shows an external view of a face of a section 1600. FIG. 16E shows a basic building element formed by combining two sections 1600. FIGS. 16F and 16G provide two other external views of section 1600 from two different sides.

Figure 17:
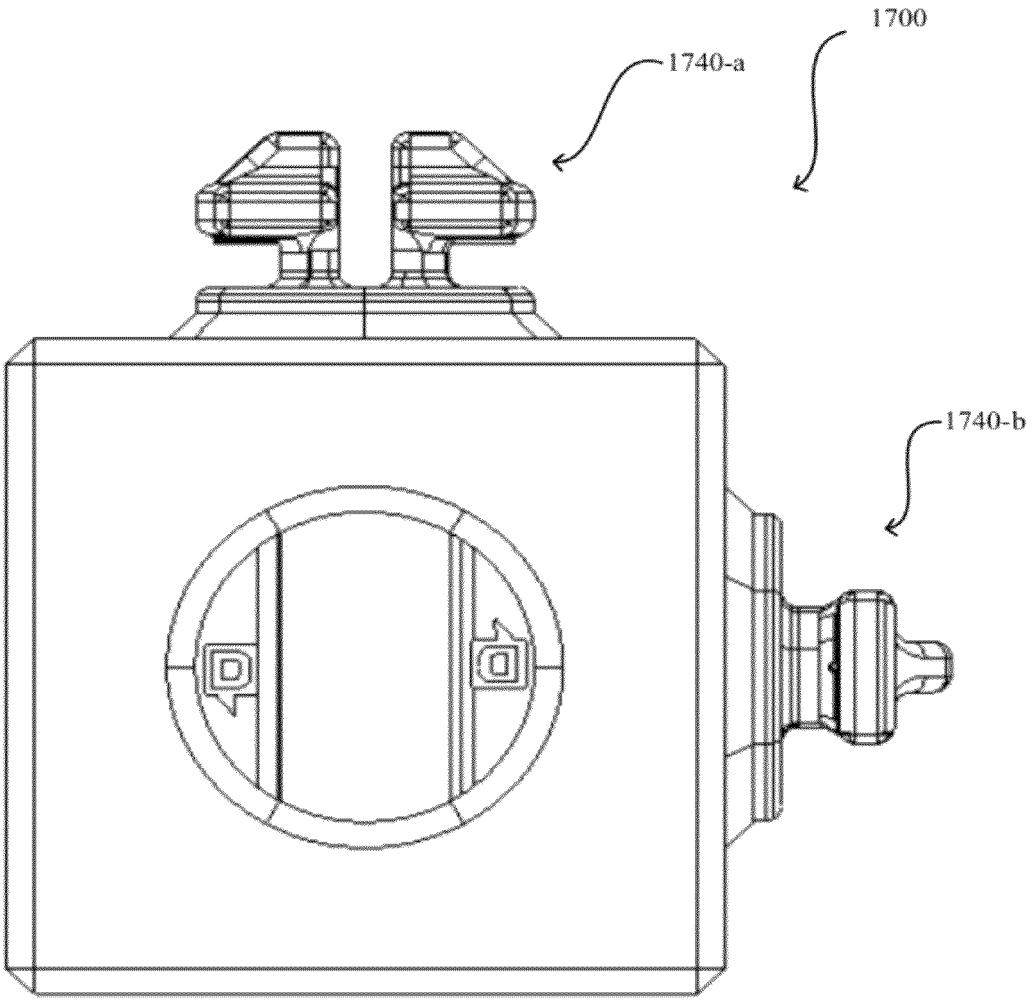
FIG. 17 shows an example of a connector building element, in accordance with various embodiments.
Figure 18:
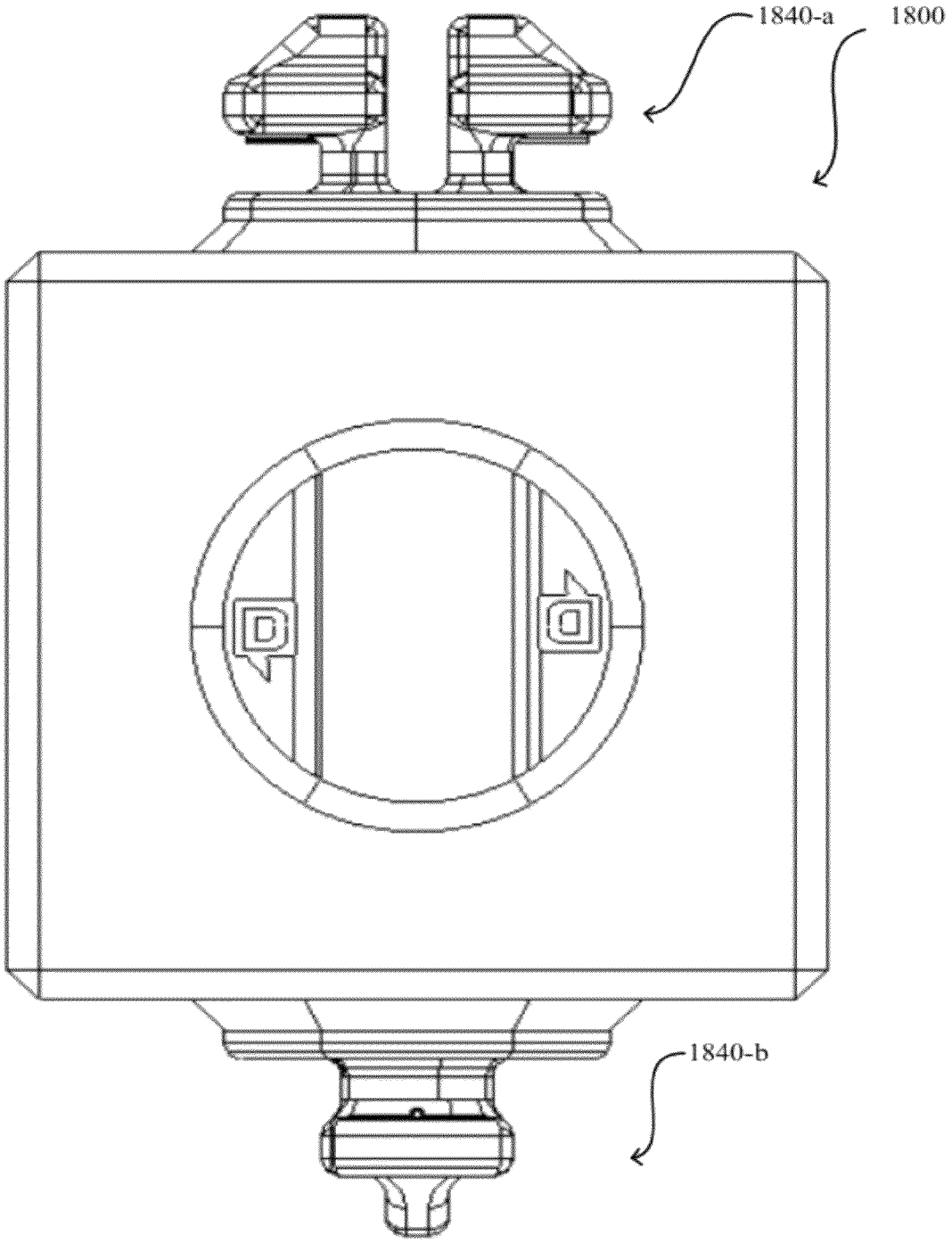
FIG. 18 shows an example of a connector building element, in accordance with various embodiments.

FIGS. 17 and 18 provide several examples of connector building elements with multiple connector portions. For example, FIG. 17 shows connector building element 1700, similar to connector building element 1300, with a first connector portion 1740-*a* and a second connector portion 1740-*b*, where these connector portions are similar to connector portions 1340 of FIG. 13 and/or FIG. 14, for example. Some embodiments may include connector building elements with two or more connector portions such as 1740. FIG. 17 shows an embodiment where the two connector portions are coupled with adjacent faces. FIG. 18 shows connector building element 1800, similar to connector building element 1300, with a first connector portion 1840-*a* and a second connector portion 1840-*b*, where these connector portions are similar to connector portions 1340 of FIG. 13, for example. In this embodiment, connector portions are opposing faces of connector building element 1800. While connector building elements 1700 and 1800 show examples with two connector portions each, some embodiments may include more or less connector portions. For example, FIG. 13 shows a connector building element 1300 with one connector portion. Some embodiments, however, may have connector building elements with 3, 4, 5, or 6 connector portions.

Figure 19A:
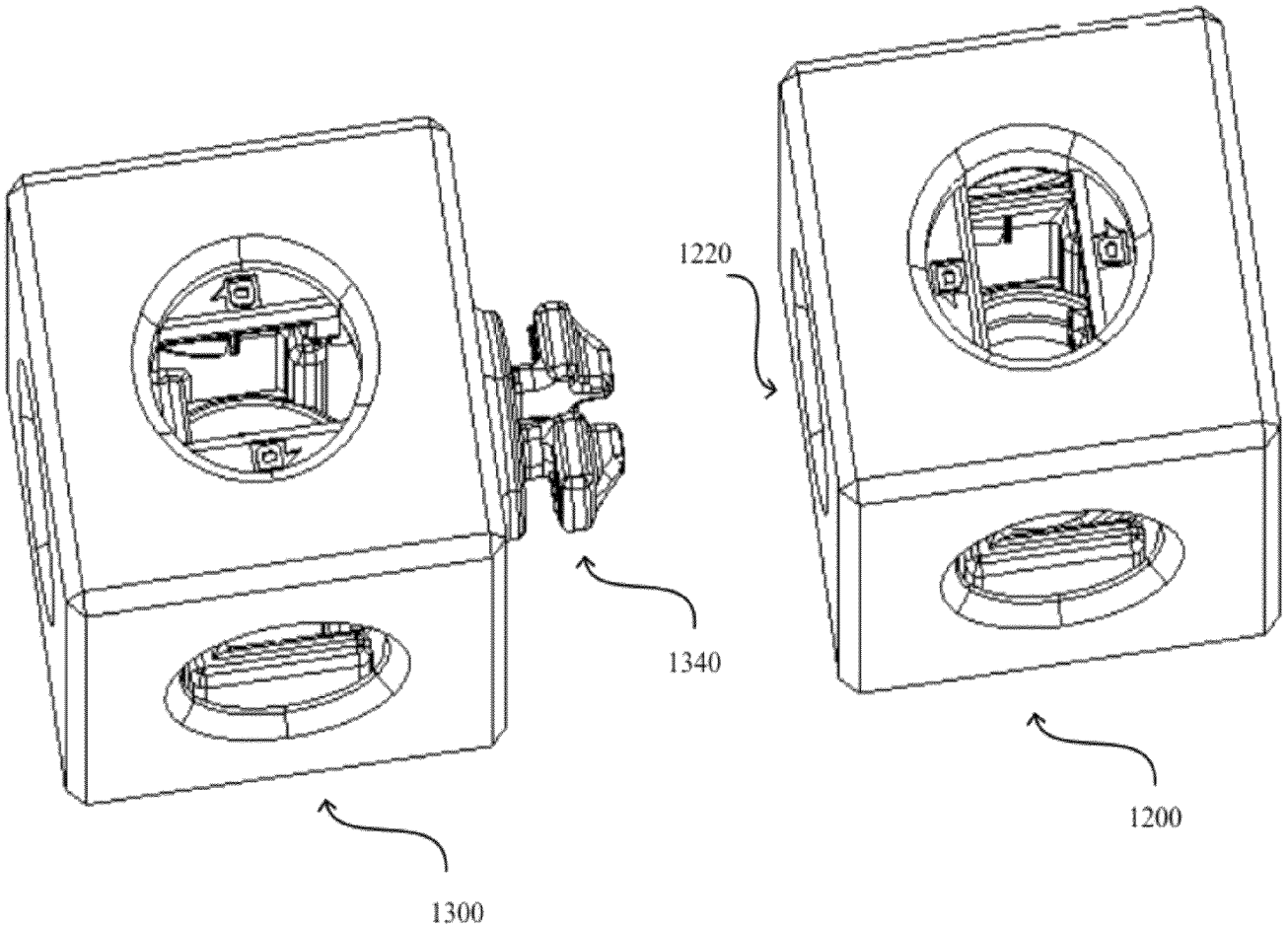
FIGS. 19A-C show a process of connecting a basic building element with one or more connector building elements to create a puzzle segment, in accordance with various embodiments.
Figure 19B:
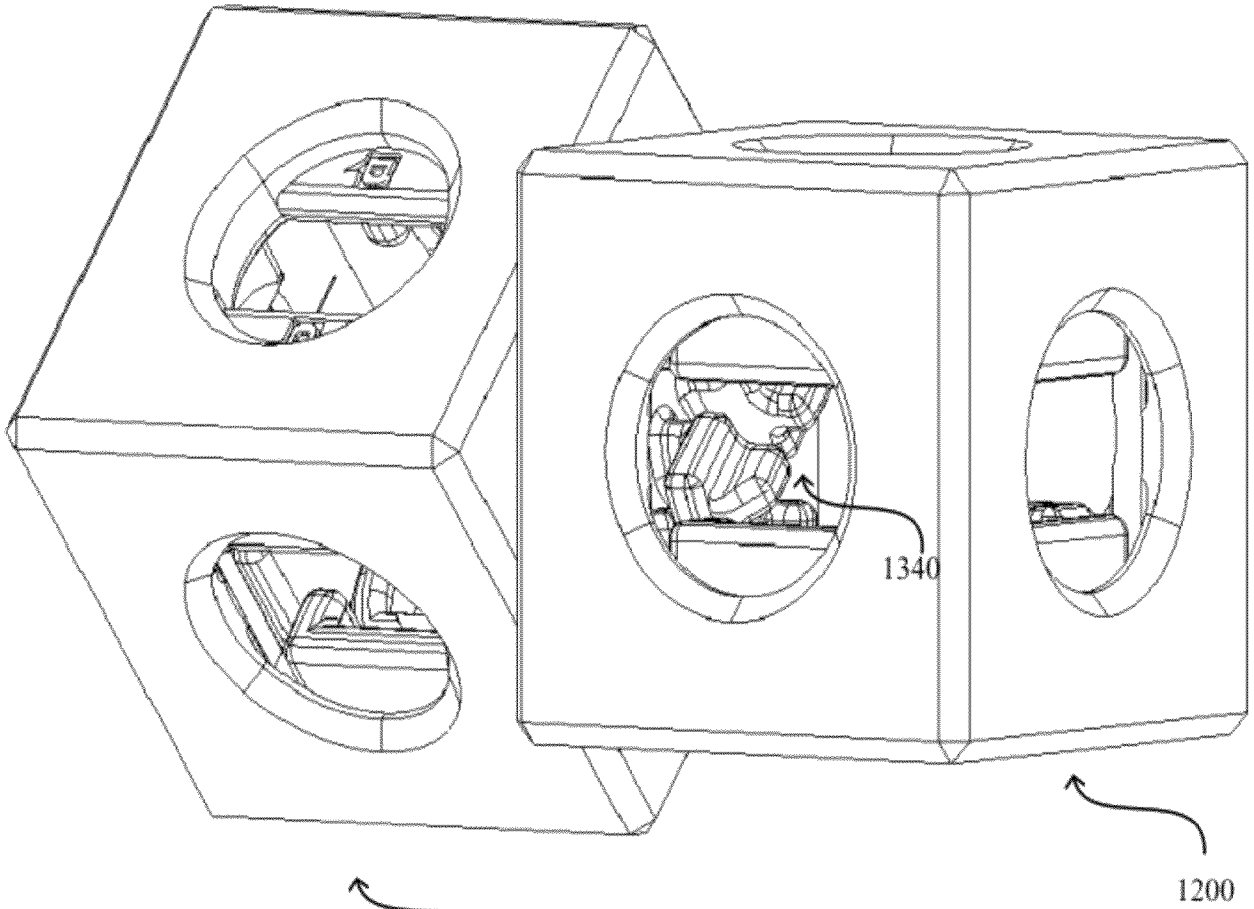
Figure 19C:
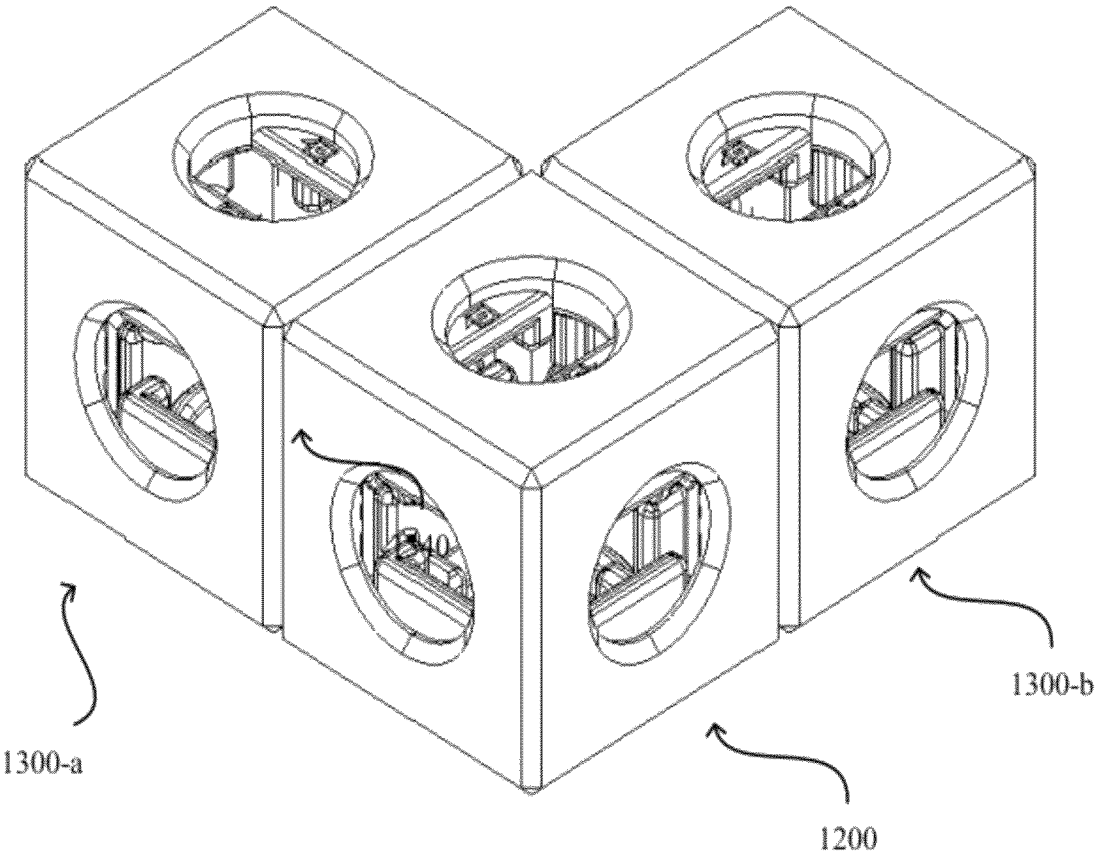

Connector building elements and/or basic building elements may be coupled with each other attachably and detachably to create three dimensional puzzle segments, composite elements, and other combinations in a variety of shapes and sizes to create puzzles of wide variety. FIGS. 19A-19C provide several examples of combining or connecting a connector building element 1300 to a basic building element 1200. In FIG. 19A, connector building element 1300 is oriented such that connector portion 1340 aligns with receiving portion 1220 of basic building element 1200. FIG. 19B shows connector building element 1300 after connector portion 1340 has been received by receiving portion of basic building element 1200 and then is rotated. FIG. 19C then shows the result of combining multiple connector building elements 1300-*a* and 1300-*b* with a basic building element 1200, where respective faces or edges of respective elements are aligned.

Figure 20:
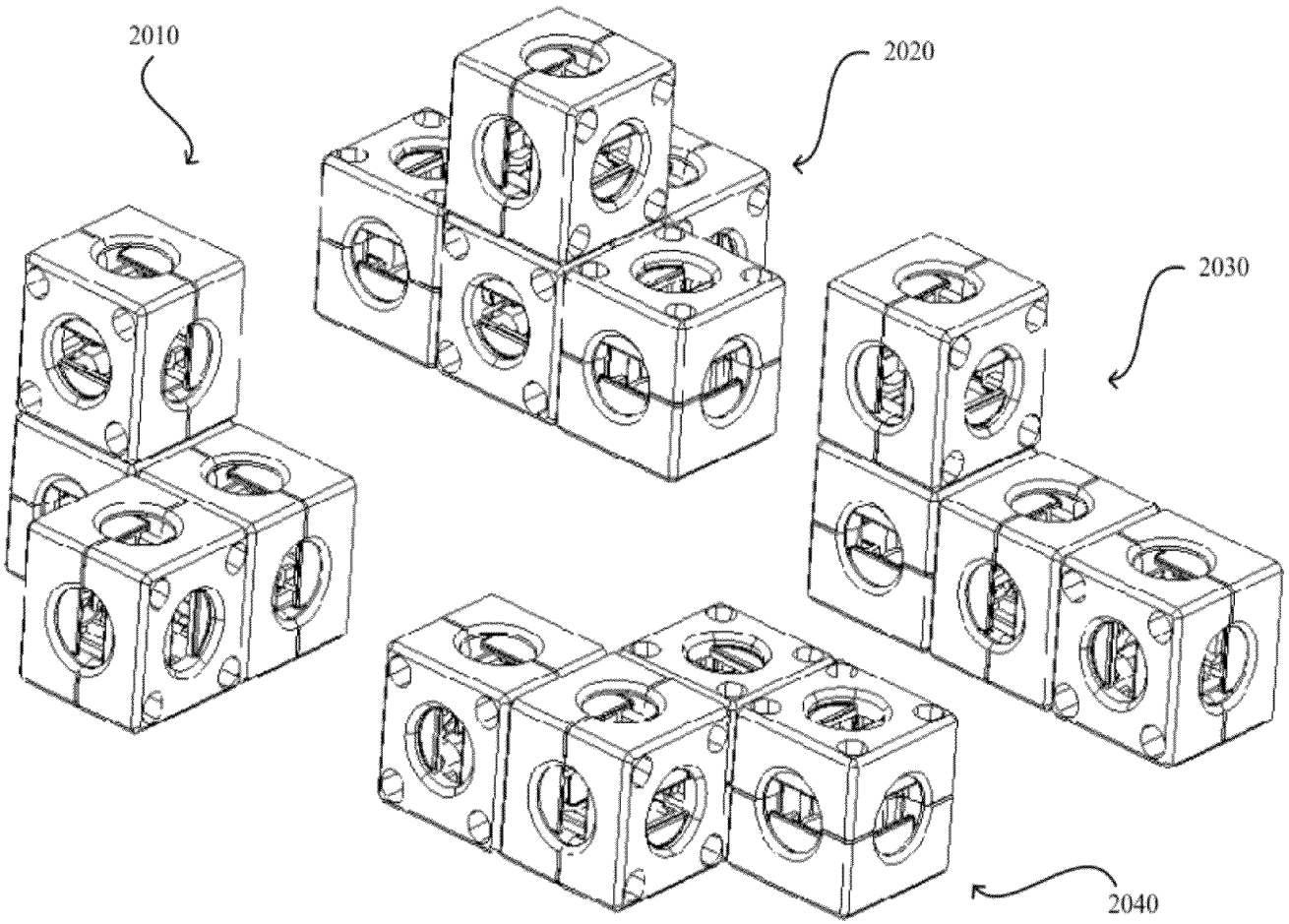
FIG. 20 shows several examples of puzzle segments created by combining one or more basic building element with one or more connector building elements, in accordance with various embodiments.
Figure 21:
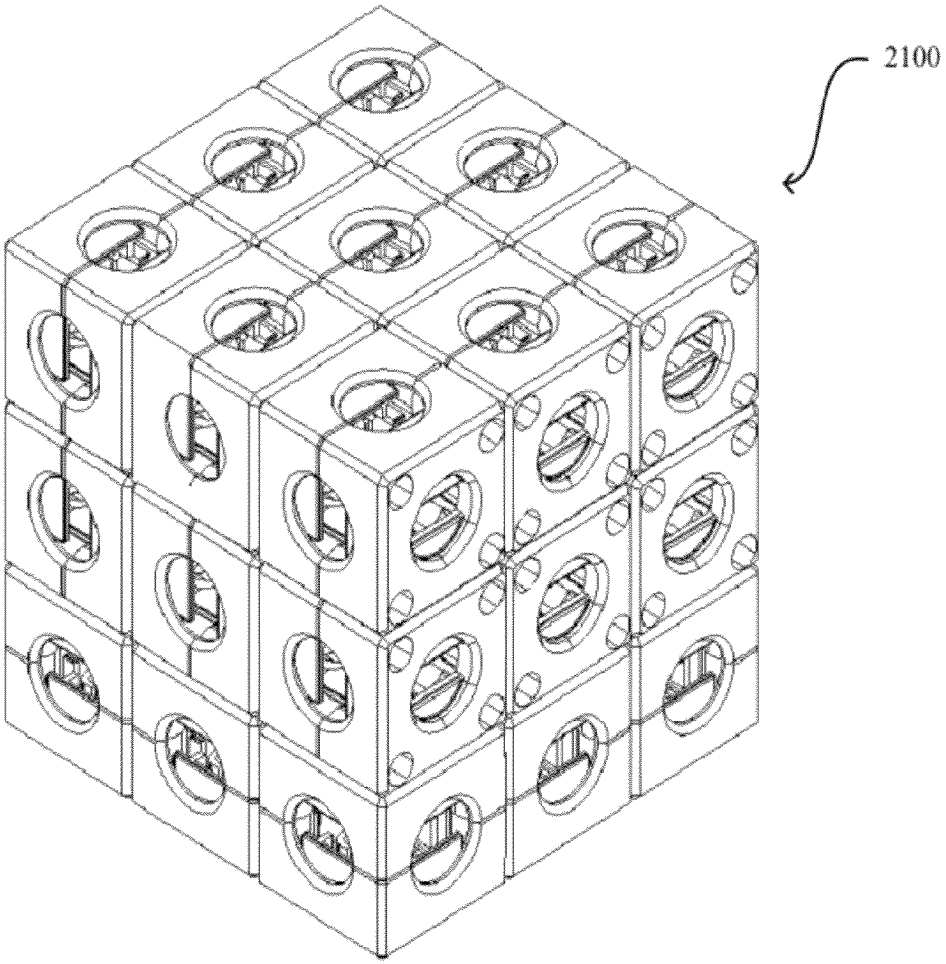
FIG. 21 shows a puzzle formed by assembling multiple puzzle segments, forming a cube in this case, in accordance with various embodiments.

FIG. 20 provides several examples of puzzles segments 2010, 2020, 2030, and 2040 that may be created by multiple connector building elements, such as element 1300 of FIG. 13, and/or multiple basic building elements, such as element 1200 of FIG. 12. While FIG. 20 provides four examples of puzzle segments, many different combinations of connector building elements and/or basic building elements may be combined to create different puzzle elements. Merely by way of example, multiple puzzle segments may be assembled to create an puzzle configuration, such as puzzle configuration 2100 of FIG. 21 that shows a three dimensional cube in this case, though numerous other puzzle configurations are possible with the building elements. A puzzle configuration such as 2100 may be disassembled into its puzzle segments and provided or presented to another who may they reassemble the puzzle segments into the puzzle configuration.

Figure 22:
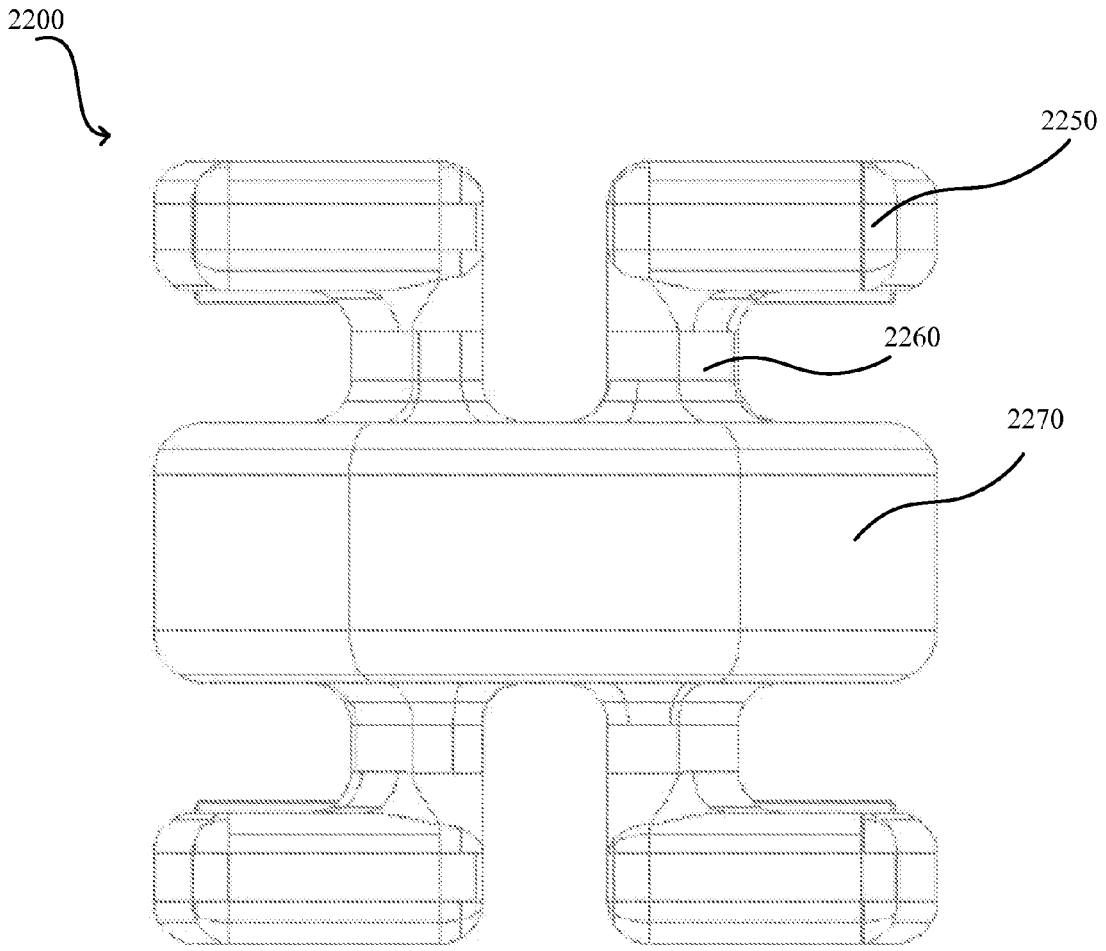
FIGS. 22 and 23 show connector elements, in accordance with various embodiments.
Figure 23:
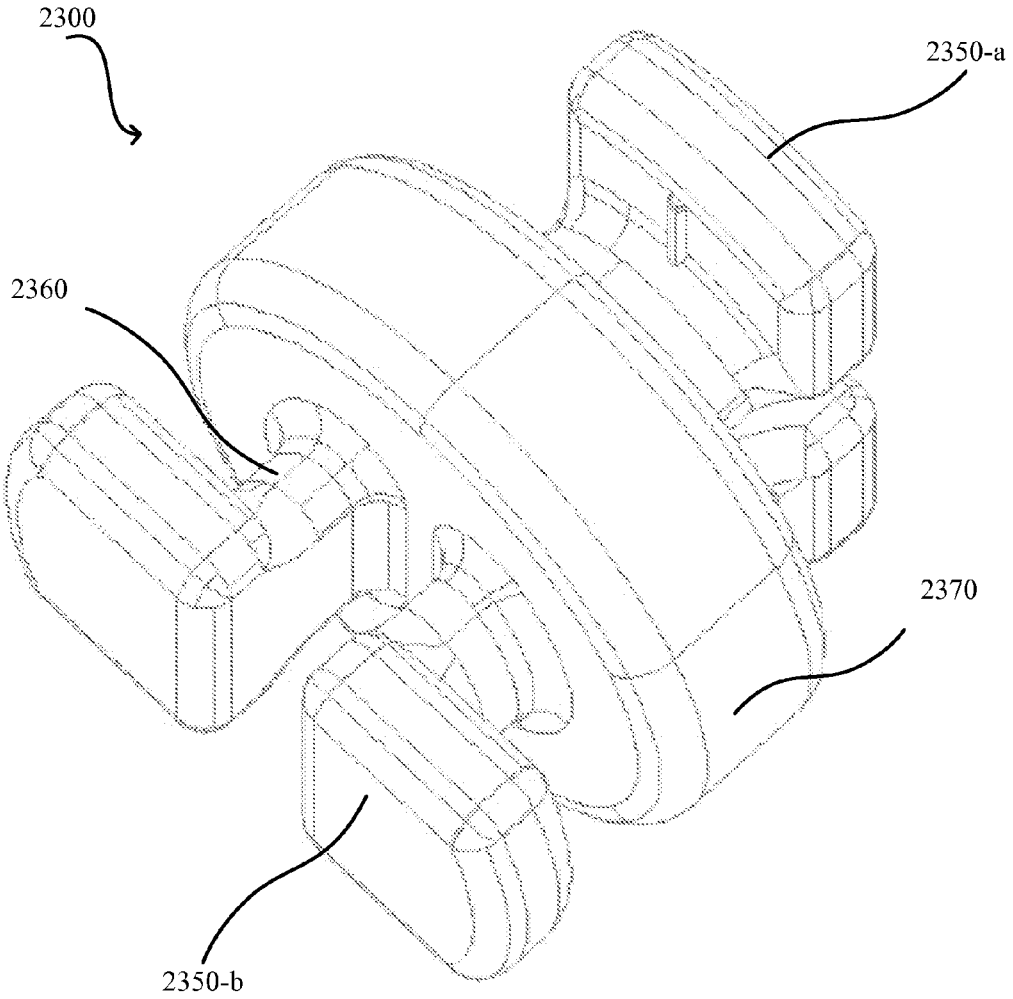

FIGS. 22 and 23 show embodiments involving connector elements 2200 and 2300. A connector element, such as 2200 and/or 2300, may be used to connect a basic building element, such as element 1200 of FIG. 12, with another basic building element, for example. In some embodiments, connector elements like 2200 and/or 2300 may be separate from connector building element, such as element 1300 of FIG. 13, and/or basic building element, such as element 1200 of FIG. 12, but may be coupled with connector building element and/or basic building elements. Connector elements like 2200 and 2300 may include structural aspects similar or the same as a connecting portion 1340 and/or connecting pin of a connector building element 1300 as discussed above. In some embodiments, a connector element may also be used to connect a connector building element to a connector building element, or a basic building element with a connector building element. In some embodiments, a connecting element may include different alignments with respect to the connecting portions that may be inserted into a connector building element and/or basic building element. In general, connector elements like 2200 and 2300 include multiple lateral structures 2250 and 2350, which may be similar to lateral structures 1350 seen in FIGS. 13 and/or 14. In addition, connector elements 2200 and/or 2300 may include longitudinal structures 2260 and/or 2360, similar to longitudinal structure 1460 of FIG. 14. Connector elements 2200 and/or 2300 may include a base portion or body structure 2270 or 2370, which may act in similar ways to platform or flange structure 1370 of connector building element 1300. FIG. 22 shows four lateral structures 2250 that are parallel to each other, while FIG. 23 shows two lateral structures 2350 (one referenced as 2350-*a*) that are parallel, while perpendicular to two other parallel lateral structures 2350 (one referenced as 2350-*b*).

Figure 24:
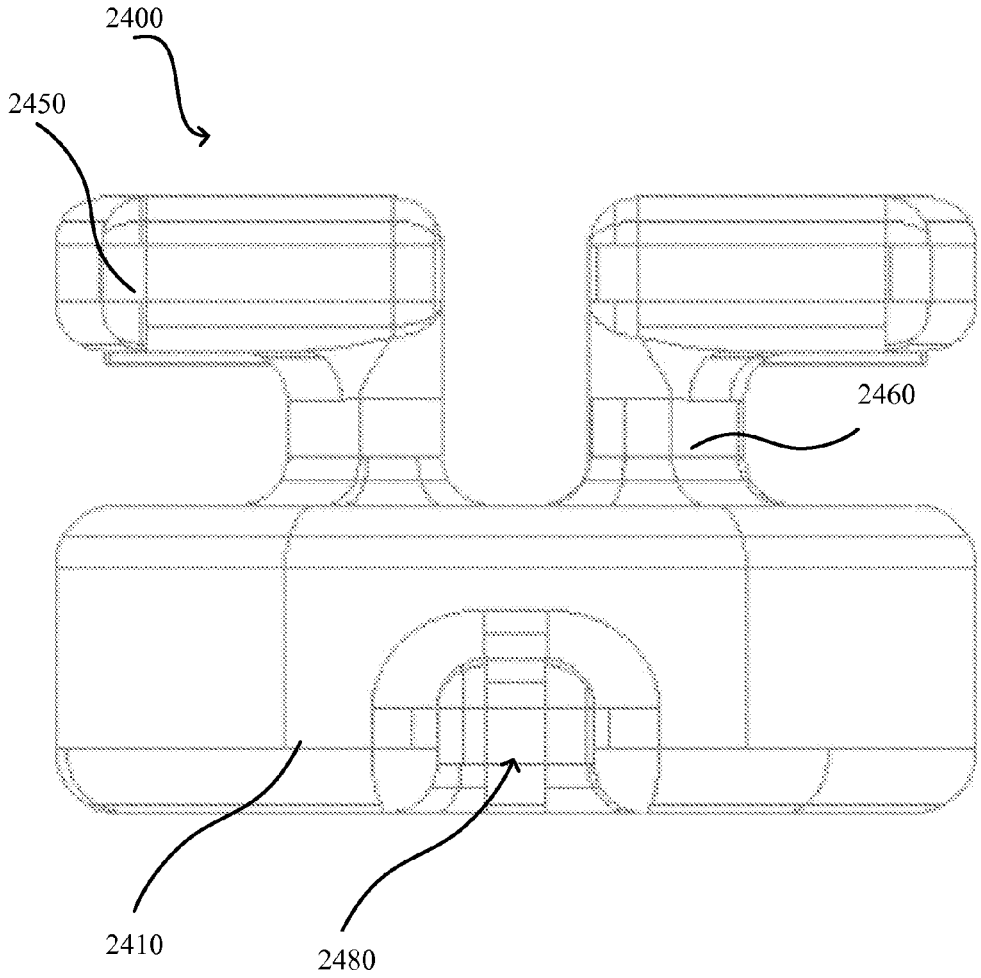
FIGS. 24, 25, and 26 show blocking elements, in accordance with various embodiments.
Figure 25:
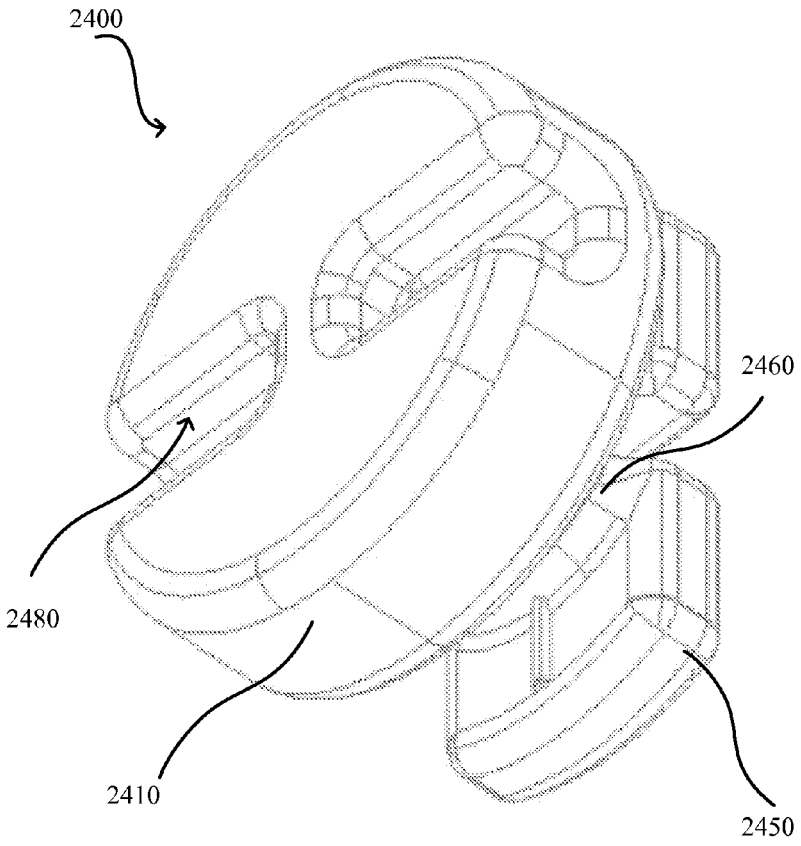
Figure 26:
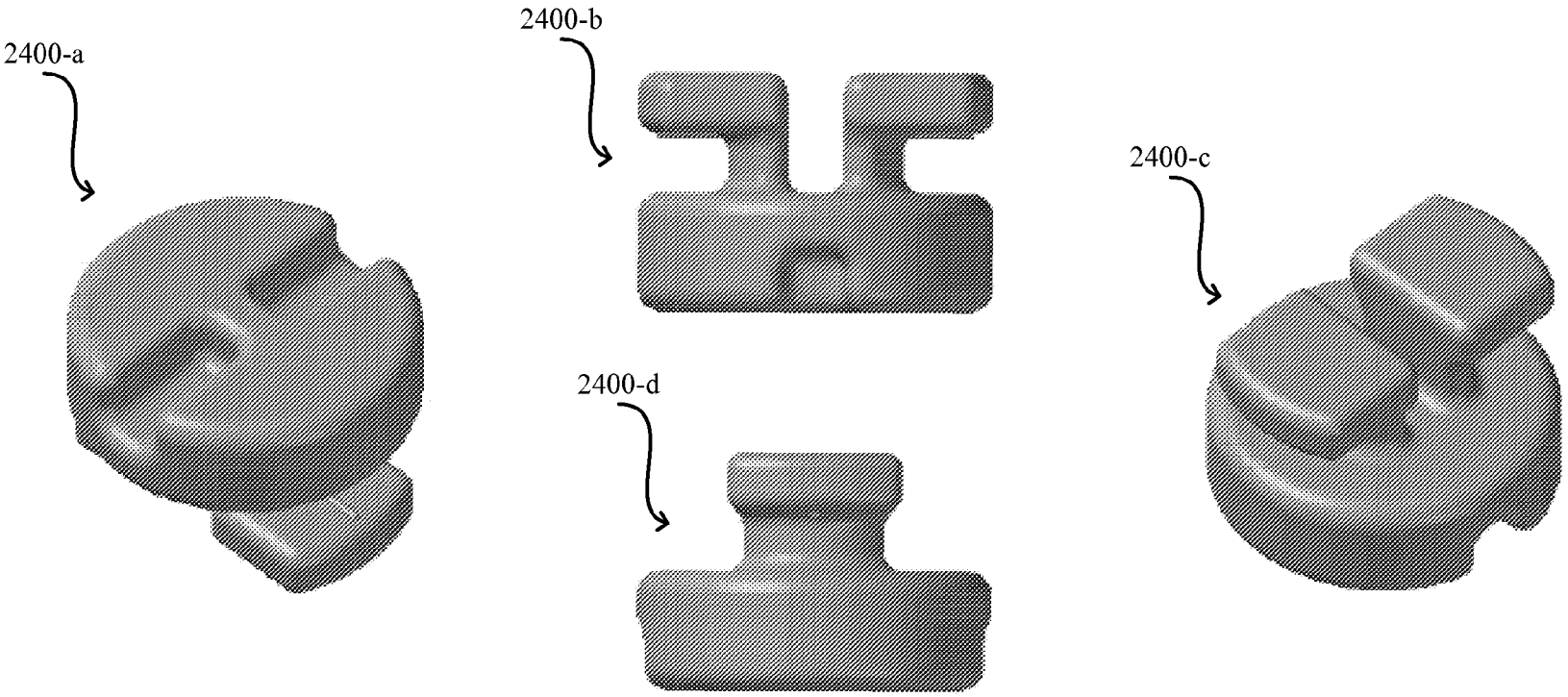

FIGS. 24, 25, and 26 show embodiments that involve a protrusion or blocking element 2400. In some embodiments, protrusion element may be referred to also as a peg. A protrusion element 2400 may be coupled with a connector building element, such as element 1300 of FIG. 13, and/or basic building element, such as element 1200 of FIG. 12, such that at least a portion of the protrusion element 2400 extends from a face of the connector building element and/or basic building element. Protrusion elements may be used to add to the complexity of elements, puzzle segments, composite elements, and/or elements made using connector building elements and/or basic building elements. Merely by way of example, a protrusion element 2400 may be used to fit into a depression, like 1230 and/or 1330 of FIGS. 12 and 13 respectively, or other receiving means of a connector building element and/or basic building element In some embodiments, multiple protrusion elements may be used such that protrusion pieces may hinder segments of connector building elements and/or basic building elements from be combined together. For example, two segments of one or more connector building elements and/or basic building elements may have protrusion elements coupled with different faces such that the protrusion elements block respective segments from being able to align with each other to create a given combined segment of a puzzle. The use of blocking elements 2400 may result in puzzle segments similar to those seen in FIGS. 4 and 5 that utilize a peg variation.

In some embodiments, a protrusion elements may include several portions. A protrusion element, such as element 2400 of FIGS. 24, 25, and 26, may include a head portion or protrusion portion 2410 that may extend in part from the face of a connector building elements and/or basic building elements that it may be coupled with. A portion of the protrusion element 2400 may also be configured to couple with a connector building element and/or basic building element. In some embodiments, this portion may be configured like the connecting portion 1340 of a connector building element, as seen in FIG. 13. Protrusion element 2400 may include lateral structures 2450, similar to lateral structures 1350 of FIGS. 13 and/or 14, and longitudinal structures 2460, similar to structures 1460 of FIG. 14, that may be inserted into a receptor or receiving portion of a connector building element and/or basic building element. In addition, protrusion element 2400 may include one or more slots 2480, which may act to receive a screwdriver-like element to help in rotating the protrusion element into a held or locking position. In some embodiments, protrusions such as protrusions 1480 of FIG. 14 may be utilized as a screwdriver-like element to fit into one or more slots like 2480 to rotate a protrusion element 2400 into place.

Embodiments may thus include structures, elements, or aspects for combining elements in different. Merely by way of example, connector building elements such as element 1300 of FIG. 13 with connecting portion that include a first and second ridge, or protrusions 1480, as shown in FIG. 14. These may also be described as humps, merely by way of example. These ridges or protrusions may be inserted into a first and second slot 2480 on a protrusion piece 2400 of FIG. 24, merely by way of example. These slots may also be referred to as cavities. This design may allow the protrusions 1480 to be used as a screw driver type tool to attach and detach blocking elements 2400 in some embodiments. In some embodiments, a blocking or protrusion element, like 2400, may include a first slot and a second slot separated from each other. In this way, the ridges and slots may be coupled to maintain alignment while a rotation occurs. A connector building element may then be rotated to secure the protrusion piece to a respective connector building element or basic building element into which the protrusion piece has been inserted. Some embodiments may utilize different tool-like structures to combine other elements, such as connector building element, basic building element, and/or connecting elements. Some embodiments may utilize different features to facilitate a combining of elements. While the figures show a tool component based on a double ridge/double slot structure, other embodiments may utilize more or less structure. For example, some embodiment may utilize a single ridge and single slot combination, while other may utilize three or more ridges combined with three or more ridges. Different designs may also utilize different features besides ridge and slot combinations.

It should be noted that the methods, systems, and components discussed above are intended merely to be examples. It must be stressed that various embodiments may omit, substitute, or add various procedures or components as appropriate. For instance, it should be appreciated that, in alternative embodiments, the methods may be performed in an order different from that described, and that various steps may be added, omitted, or combined. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. Also, it is noted that the embodiments may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure.

Furthermore, some embodiments may be implemented by hardware, software, firmware, middleware, microcode, hardware description languages, or any combination thereof. When implemented in software, firmware, middleware, or microcode, the program code or code segments to perform the necessary tasks may be stored in a computer-readable medium such as a storage medium. Processors may perform the necessary tasks.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention, which is defined in the following claims.

What is claimed is:

1. A puzzle construction system, comprising:

a plurality of basic building elements, wherein each basic building element includes:

a plurality of external faces, wherein one or more of the external faces includes a receiving portion; and a plurality of blocking structures, each blocking structure configured to block a respective lateral structure of a connecting portion of a connector building element in a position such that an external face of a respective connecting building element aligns with an respective external face of a respective basic building element; and a plurality of locking structures, each locking structure configured to maintain a respective lateral structure of a respecting connecting portion of a respective connector building element in the position such that a respective external face of a connector building element aligns with a respective external face of a respective basic building element; and a plurality of connector building elements, wherein each connector building element includes:

a plurality of external faces, wherein at least a subset of the external faces include a receiving portion; and at least a subset of the external faces couple with a connecting portion, the connecting portion including one or more longitudinal structures and one or more lateral structures coupled with an end portion of one of the respective longitudinal structures, and wherein one or more of the basic building elements further comprises a plurality of internal ramp structures, each internal ramp structured configured to provide compressive force to a respective lateral structure of a respective connecting portion of a respective connector building element and wherein at least one of the respective internal ramp structures includes a portion with a first width and a second width such that a respective lateral structure receives the compressive force when the lateral structure is rotated past the first width and the lateral structure is held in place against a respective blocking structure when the lateral structure aligns with the portion of the internal ramping structures with the second width.

2. The system of claim 1, wherein one or more of the respective internal ramp structures is a coupled with at least a respecting locking structure or a respective blocking structure.

3. The system of claim 1, wherein at least one of the respective locking structures includes a first portion with a first length and at least one of the respective block structures includes a second portion with a second length, the first length being less than the second length and the first portion and the second portion parallel to each other.

4. The system of claim 1, wherein at least one of the receiving portions includes an elongated opening.

5. The system of claim 4, wherein the respective receiving portion further includes a circular depression that includes the elongated opening.

6. The system of claim 1, wherein the connecting portion including one or more longitudinal structures and one or more lateral structures coupled with an end portion of the longitudinal structure is configured as T-shaped structure.

7. The system of claim 1, wherein the connecting portion including one or more longitudinal structures and one or more lateral structures coupled with an end portion of the longitudinal structure is configured as first L-shaped structure separated by a gap from a second L-shaped structure.

8. The system of claim 1, wherein the one or more lateral structures is coupled with one or more protrusions configured to act as a screw driver structure.

9. The system of claim 1, further comprising a blocking element including: a body portion, wherein the body element includes one or more slots in a first face of the body portion; one or more longitudinal structures extending from a second face of the body portion; and one or more lateral structures coupled with the one or more longitudinal structures.

10. The system of claim 1, further comprising a connector element including: a body portion; one or more longitudinal structures extending from a first side of the body portion; one or more longitudinal structures extending from a second side of the body portion; and one or more lateral structures coupled with the one or more longitudinal structures extending from the first side of the body portion and the second side of the body portion.

11. A method of constructing an intellectual challenge puzzle game, the method comprising: selecting one or more basic building elements, wherein each basic building element includes: a plurality of external faces, wherein one or more of the external faces includes a receiving portion;

a plurality of blocking structures, each blocking structure configured to block a respective lateral structure of a connecting portion of a connector building element in a position such that an external face of a respective connecting building element aligns with an respective external face of a respective basic building element; and a plurality of locking structures, each locking structure configured to maintain a respective lateral structure of a respecting connecting portion of a respective connector building element in the position such that a respective external face of a connector building element aligns with a respective external face of a respective basic building element;

selecting one or more connector building elements, wherein each connector building element includes: a plurality of external faces, wherein at least a subset of the external faces include a receiving portion; and least a subset of the external faces couple with a connecting portion, the connecting portion including one or more longitudinal structures and one or more lateral structures coupled with an end portion of one of the respective longitudinal structures; and constructing a plurality of puzzle segments, wherein each respective puzzle segment includes one or more of the selected basic building elements and one or more the selected connector building elements that are combined by inserted the connecting portion of a respective connector building element into a respective receiving portion of at least one of the selected basic building elements or the selected connector building elements and rotated until a respective lateral structure meets a respective blocking structure to form a puzzle including the plurality of puzzle segments.

12. The method of claim 11, wherein the plurality of puzzle segments are configured such that every connecting portion of the one or more respective connector building elements is inserted into a respective receiving portion of at least one of the selected basic building elements or the selected connector building elements.

13. The method of claim 11, further comprising: connecting a blocking element into at least receiving portion of a respective external face of at least one of the basic building elements or connector building elements.

14. The method of claim 11, further comprising: assembling the plurality of puzzle segments into a puzzle configuration.

15. The method of claim 14, wherein the puzzle configuration defines a three dimensional cube.

16. The method of claim 11, further comprising: disassembling the puzzle configuration into the plurality of puzzle segments; and providing the disassembled puzzle segments for reassembly by another.

17. A puzzle device for constructing intellectual challenging puzzle games, the puzzle device comprising:

a plurality of external faces, wherein one or more of the external faces includes a receiving portion;

a plurality of blocking structures, each blocking structure configured to block a respective lateral structure of a connecting portion of a connector building element in a position such that an external face of a respective connecting building element symmetrically aligns with an respective external face of a respective basic building element;

a plurality of locking structures, each locking structure configured to maintain a respective lateral structure of a respecting connecting portion of a respective connector building element in the position such that a respective external face of a connector building element symmetrically aligns with a respective external face of a respective basic building element; and a plurality of internal ramp structures, each internal ramp structured configured to provide compressive force to a respective lateral structure of a respective connecting portion of a respective connector building element, wherein at least one of the respective internal ramping structures includes a portion with a first width and a second width such that a respective lateral structure receives the compressive force when the lateral structure is rotated past the first width and the lateral structure is held in place against a respective blocking structure when the lateral structure aligns with the portion of the internal ramping structures with the second width.

18. The puzzle device of claim 17, wherein at least a subset of the external faces couple with a connecting portion, the connecting portion including one or more longitudinal structures and one or more lateral structures coupled with an end portion of one of the respective longitudinal structures.

19. The puzzle device of claim 17, wherein one or more of the respective internal ramp structures is a coupled with at least a respecting locking structure or a respective blocking structure.

20. The puzzle device of claim 17, wherein at least one of the respective locking structures includes a first portion with a first length and at least one of the respective block structures includes a second portion with a second length, the first length being less than the second length and the first portion and the second portion parallel to each other.

21. The puzzle device of claim 17, wherein at least one of the receiving portions includes an elongated opening.

22. The puzzle device of claim 21, wherein the respective receiving portion further includes a circular depression that includes the elongated opening.

23. The puzzle device of claim 17, wherein the connecting portion including one or more longitudinal structures and one or more lateral structures coupled with an end portion of the longitudinal structure is configured as T-shaped structure.

24. The puzzle device of claim 17, wherein the connecting portion including one or more longitudinal structures and one or more lateral structures coupled with an end portion of the longitudinal structure is configured as first L-shaped structure separated by a gap from a second L-shaped structure.

* * * * *